US010159330B2

(12) United States Patent
Kovac

(10) Patent No.: US 10,159,330 B2
(45) Date of Patent: Dec. 25, 2018

(54) BELT POUCH WITH DOUBLE DUTY CAPABILITY

(71) Applicant: Creative Law Enforcement Resources, Inc., South Pasadena, CA (US)

(72) Inventor: Kresimir Kovac, South Pasadena, CA (US)

(73) Assignee: Creative Law Enforcement Resources, Inc., South Pasadena, CA (US)

( * ) Notice: Subject to any disclaimer, the term of this patent is extended or adjusted under 35 U.S.C. 154(b) by 0 days.

(21) Appl. No.: 15/432,284

(22) Filed: Feb. 14, 2017

(65) Prior Publication Data

US 2018/0228273 A1 Aug. 16, 2018

(51) Int. Cl.

| | |
|---|---|
| ***A45F 5/02*** | (2006.01) |
| ***F42B 39/02*** | (2006.01) |
| ***H02J 7/00*** | (2006.01) |

(52) U.S. Cl.

CPC ..... *A45F 5/021* (2013.01); *F42B 39/02* (2013.01); *H02J 7/0044* (2013.01)

(58) Field of Classification Search

CPC ..... F42B 39/02; F42B 39/08; F42B 39/082; A45C 2011/002; A45F 2200/0591; A45F 5/021; A45F 2200/0516

See application file for complete search history.

(56) References Cited

U.S. PATENT DOCUMENTS

| | | | | |
|---|---|---|---|---|
| 6,202,908 | B1 * | 3/2001 | Groover | F42B 39/02 224/236 |
| 7,889,494 | B2 * | 2/2011 | Stampfli | A45F 5/00 224/663 |
| 2016/0370144 | A1 * | 12/2016 | Laemmlen | A45F 5/02 |

* cited by examiner

*Primary Examiner* — Corey Skurdal

(74) *Attorney, Agent, or Firm* — Smyrski Law Group, A P.C.

(57) ABSTRACT

An apparatus is provided including an ammunition magazine, a container fixedly connected to the ammunition magazine, a modular insert configured to fixedly fit within the container, in one embodiment having an opening therein sized to receive an electrical device, and attachment hardware configured to attach the container to a belt worn by a user.

26 Claims, 49 Drawing Sheets

FIG. 29A
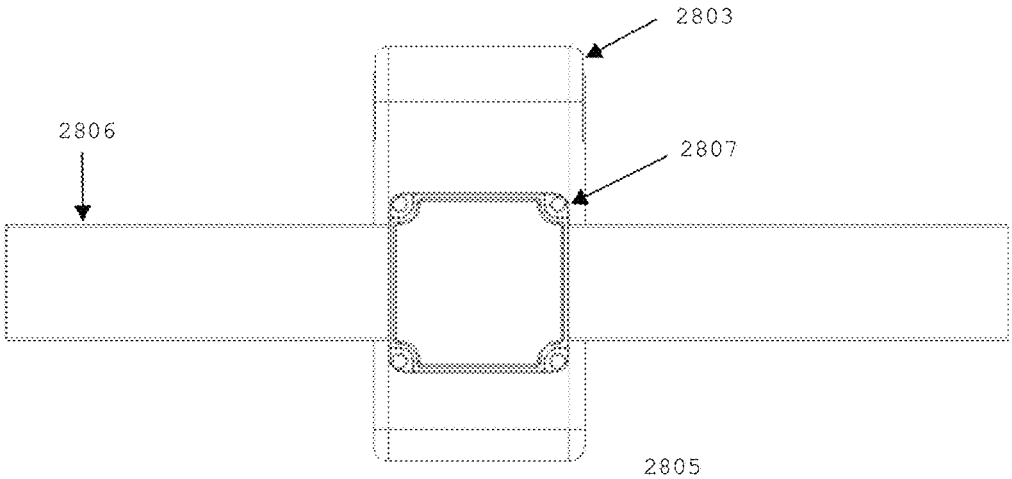
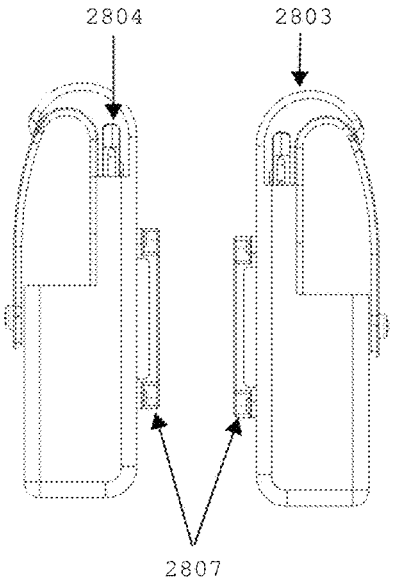
FIG. 29B
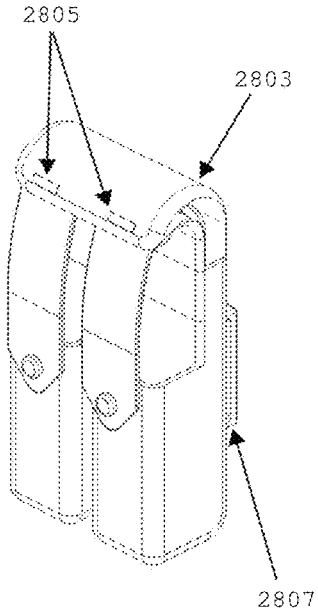
FIG. 29C

FIG. 30A
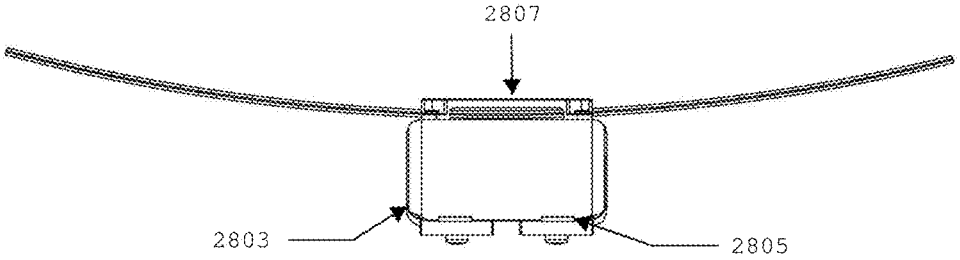
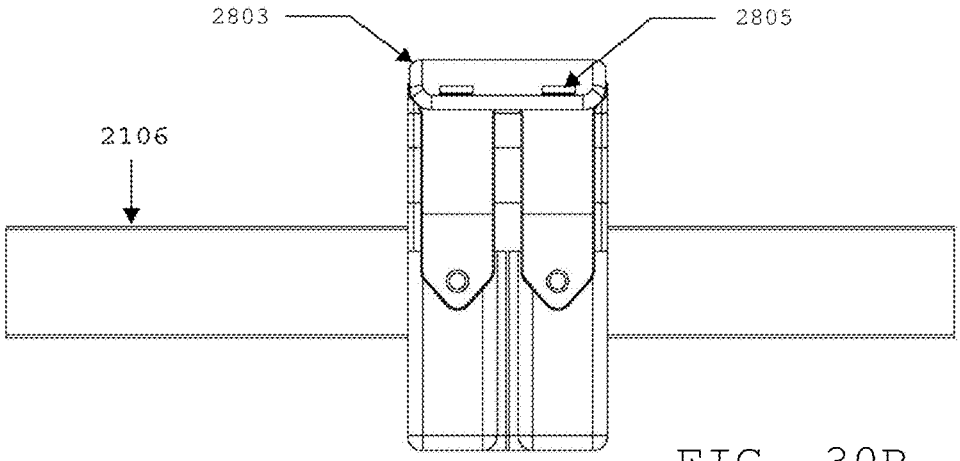
FIG. 30B
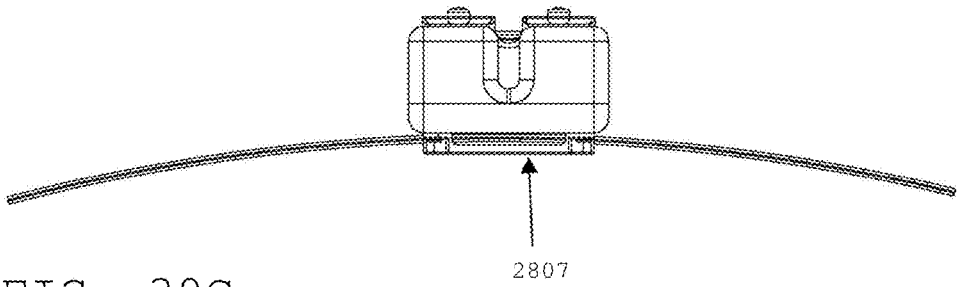
FIG. 30C

FIG. 31A
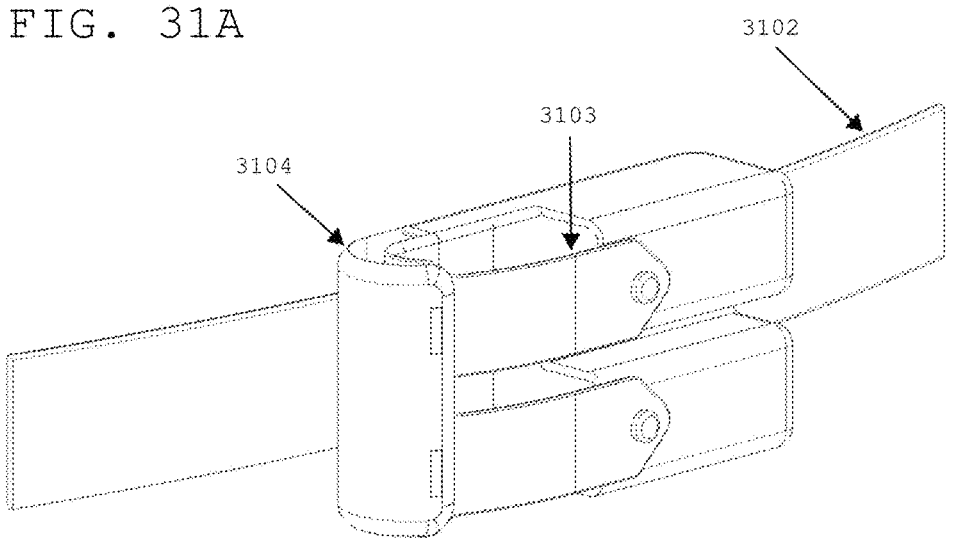
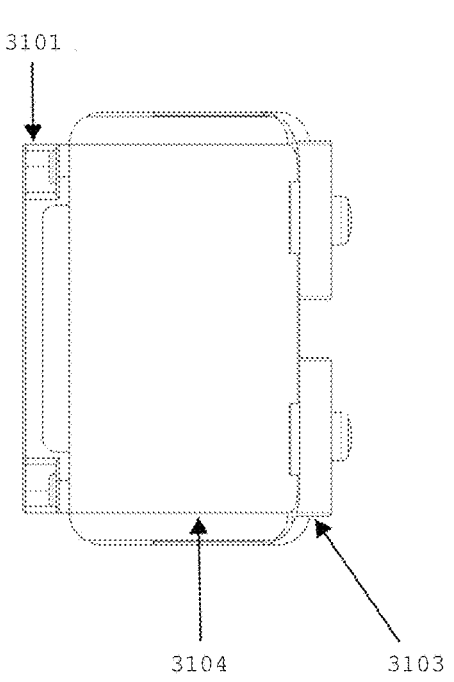
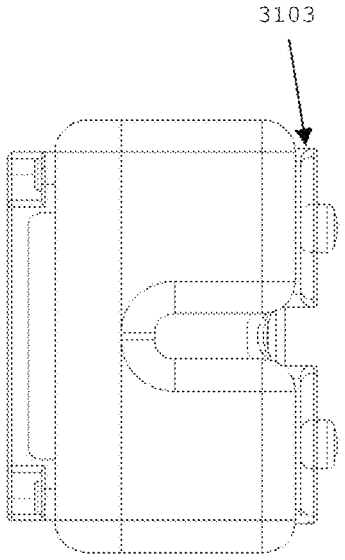
FIG. 31C
FIG. 31B

FIG. 32A
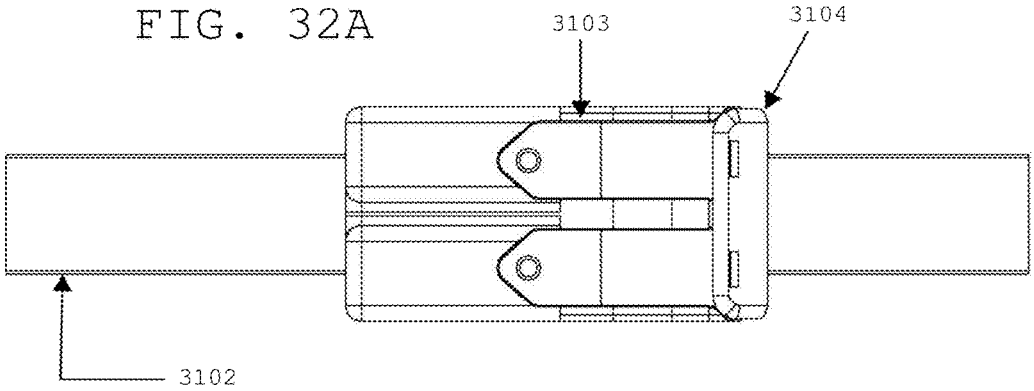
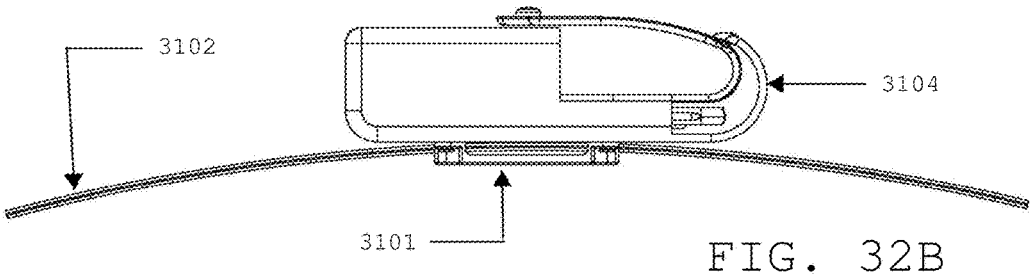
FIG. 32B
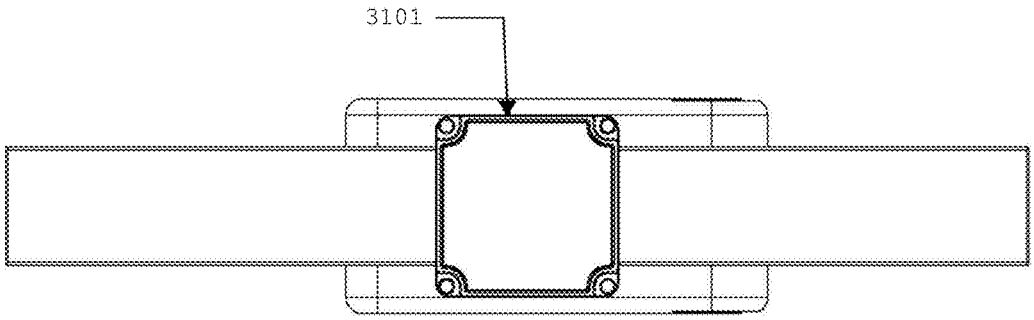
FIG. 32C

FIG. 35A
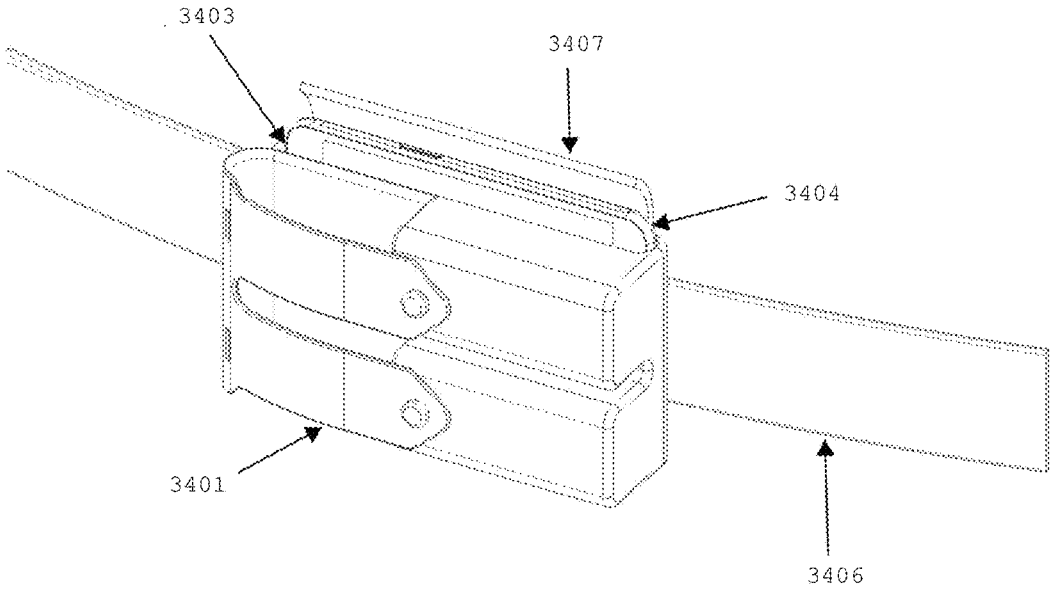
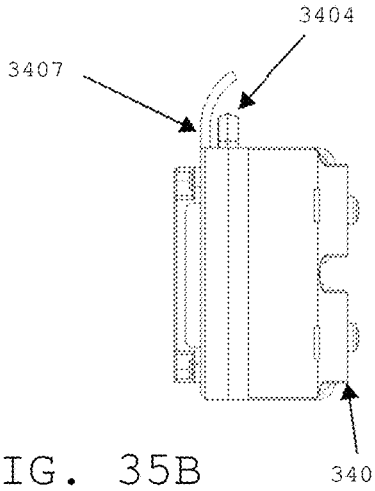
FIG. 35B
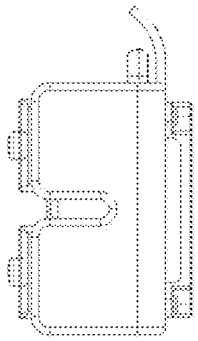
FIG. 35C

FIG. 36A
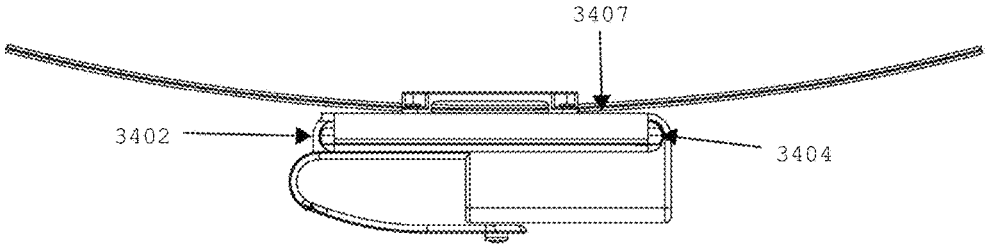
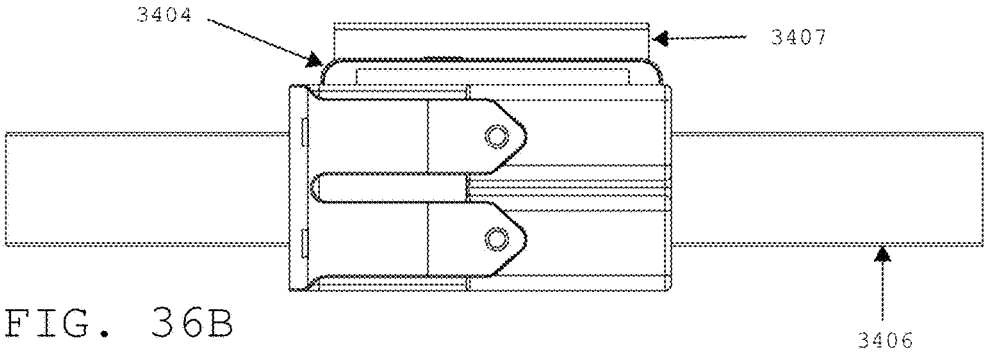
FIG. 36B
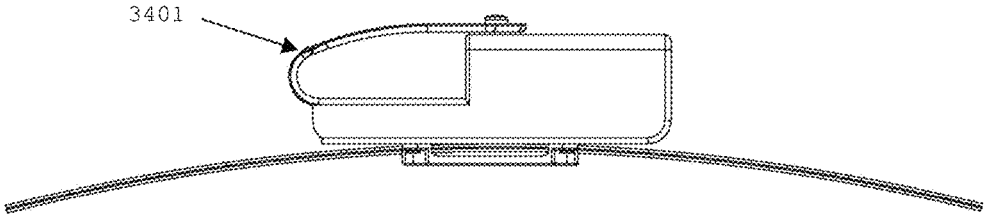
FIG. 36C

FIG. 37A
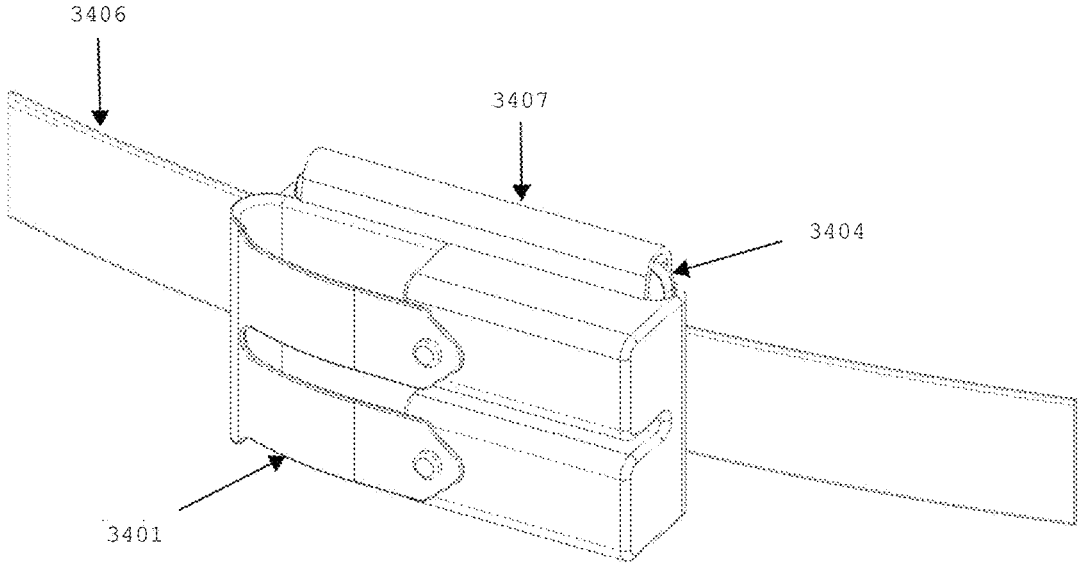
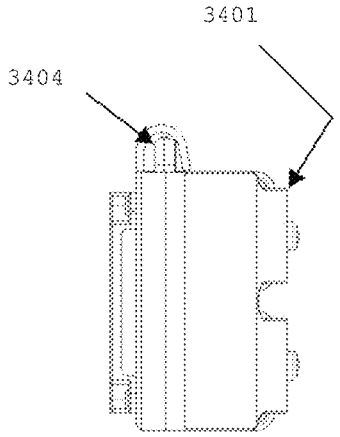
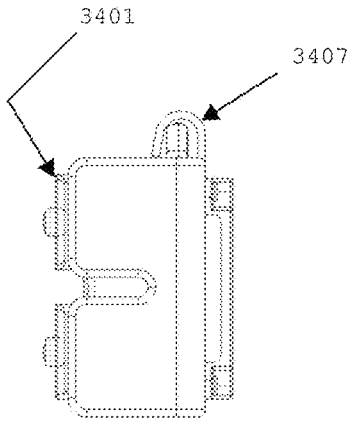
FIG. 37B
FIG. 37C

FIG. 38A
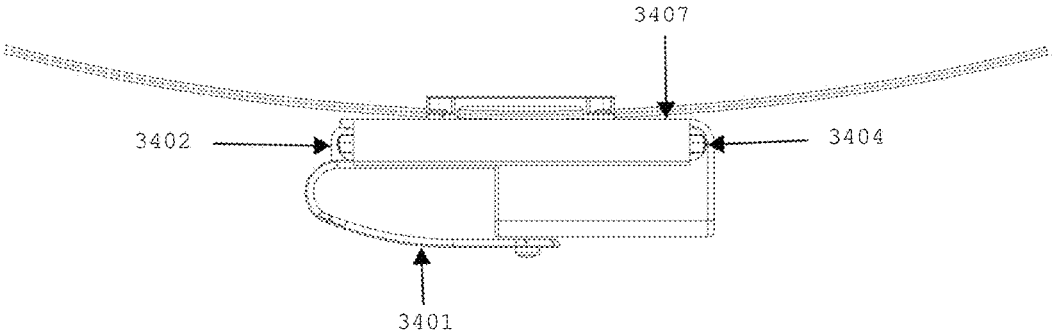
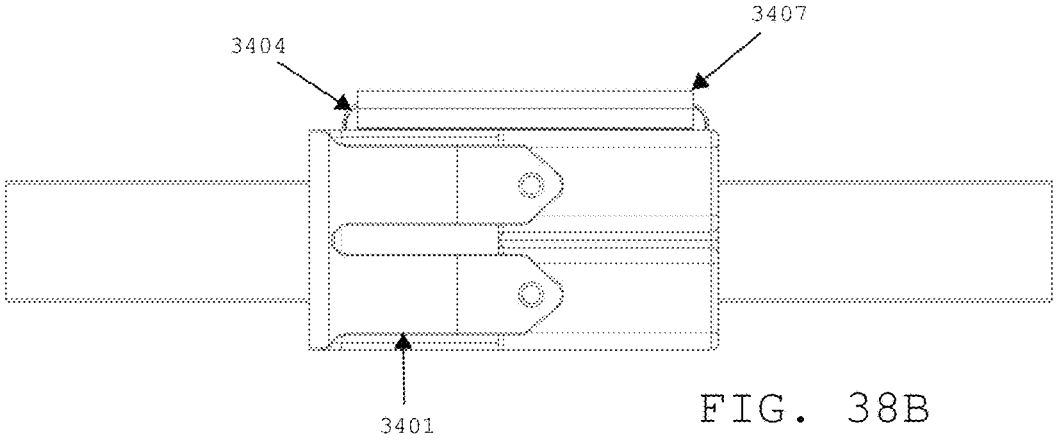
FIG. 38B
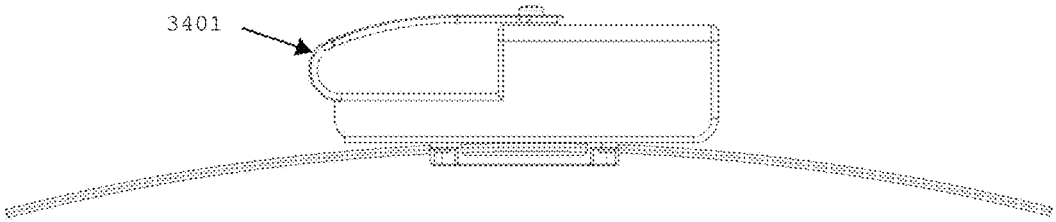
FIG. 38C

FIG. 40A
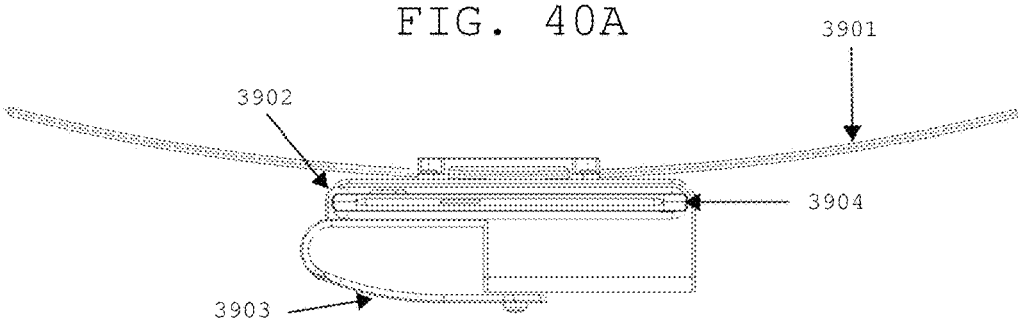
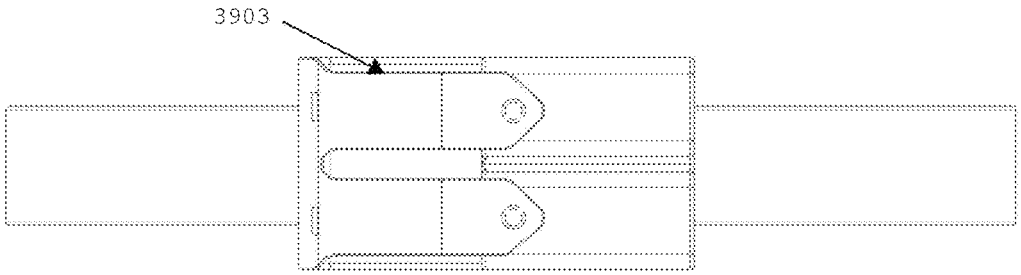
FIG. 40B
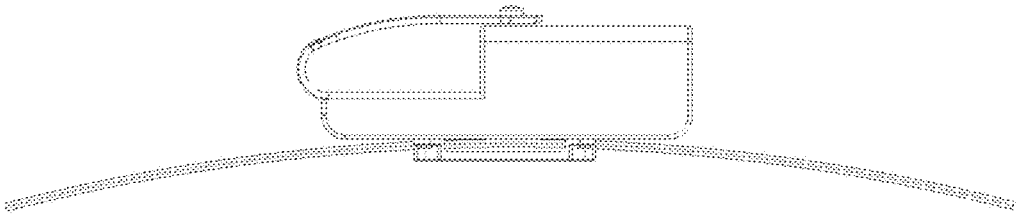
FIG. 40C

FIG. 41A
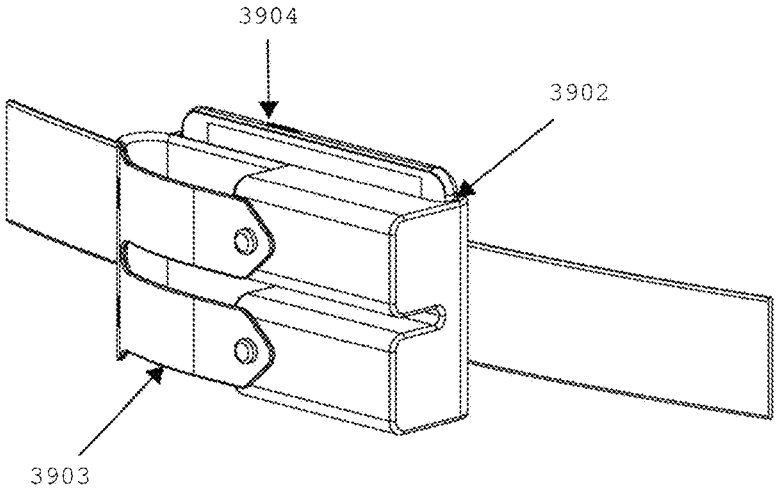
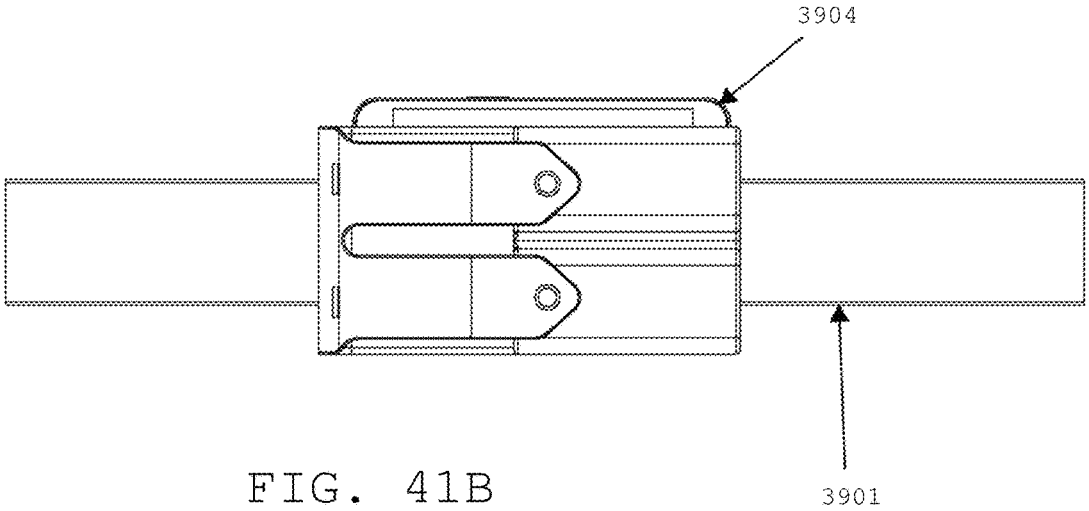
FIG. 41B

BELT POUCH WITH DOUBLE DUTY CAPABILITY

This application is related to U.S. patent application Ser. No. 14/620,748, entitled "Belt System for Use with Video/Audio Recording Devices," inventor Kresimir Kovac, filed Feb. 12, 2015, U.S. patent application Ser. No. 15/236,800, entitled "Belt System Interface Apparatus For Use With Radio Transmitter," inventor Kresimir Kovac, filed Aug. 15, 2016, and U.S. patent application Ser. No. 15/179,649, entitled "System For Managing Information Related To Recordings From Video/Audio Recording Devices," inventor Kresimir Kovac, filed Jun. 10, 2016, the entirety of all of which are incorporated herein by reference.

The present application is also being filed concurrently with a design patent application, 29/593,924, inventor Kresimir Kovac, entitled "Duty Belt Pouch," the entirety of which is incorporated herein by reference.

BACKGROUND

I. Field

The present disclosure relates generally to the field of pouches or receptacles used to carry equipment and devices on a duty belt or similar device by a peace officer, security officer, military personnel or others.

II. Description of the Related Art

Peace officers, security officers and military personnel throughout the world are tasked with duties dealing with a variety of dangerous situations. These situations often involve the need for specialized tools to facilitate an optimal outcome. The tools are employed in order to detain or arrest violent people, save lives, report activities, etc. Many of the most import law enforcement tools are carried in a variety of pouches and holsters mounted onto a law enforcement duty belt. This allows for the tools to be carried directly on the person so they may be deployed upon a moment's notice as needed by the peace officer. Due to the variety of tasks and different types of situations addressed by peace officers, the amount of law enforcement tools carried on the duty belt may be significant. These tools include but are not limited to a handgun, handcuffs, solid baton, collapsible baton, extra ammunition magazines for the handgun, police radio, keys, pepper spray, flashlight, Taser, etc.

Each of the tools is carried inside a purpose built pouch on the duty belt. These pouches and holsters often have specialized retention systems built into them to ensure the tool is not lost or removed from the pouch without the officer's knowledge. Each pouch requires a specific amount of belt space in order to be mounted on the duty belt. Some pouches require a larger space than others. For example, a handcuff pouch is much wider than a flashlight pouch.

The amount of tools carried on the duty belt, in pouches, often exceeds the amount of space available on the belt to mount them. This space issue is heightened for officers with smaller waists. Simply, there is less room to mount pouches on a smaller sized duty belt. With the advent of technology, the need to carry additional devices is growing dramatically. For example, carrying a Taser electronic control device inside a belt-mounted holster is currently considered a normal and standard piece of equipment carried by an officer. With the advent of body worn cameras, the expectation is that this device will also be worn by peace officers without eliminating any of the other previously listed critical equipment from the duty belt. There is a need to maximize space on an officer's duty belt in order to be able to effectively carry more mission critical equipment.

Newer equipment may include electronic devices, including but not limited to smartphones or processing type devices such as that shown in U.S. patent application Ser. No. 14/620,748, entitled "Belt System for Use with Video/Audio Recording Devices," inventor Kresimir Kovac, filed Feb. 12, 2015, and such electronic devices may also necessitate placement on a peace officer's duty belt and require a certain amount of space on the belt.

It would therefore be beneficial to provide a device or system that addresses issues with previously available belt devices used by peace officers in light of the limited space available on a duty belt and the need to carry additional equipment.

SUMMARY

According to one aspect of the present design, there is provided an apparatus comprising an ammunition magazine or magazines, a container fixedly connected to the ammunition magazine or magazines, a modular insert configured to fixedly fit within the container, in one embodiment having an opening therein sized to receive an electrical device, and attachment hardware configured to attach the container to a belt worn by a user.

According to another aspect of the design, there is provided an apparatus configured to hold ammunition comprising a magazine, a container attached to a back side of the magazine, a modular insert configured to fixedly fit within the container and having an opening therein, and attachment hardware configured to attach the container to a belt worn by a user. In one embodiment, the modular insert is sized to receive an electrical device.

According to a third aspect of the design, there is provided a belt mountable apparatus configured to hold ammunition comprising a magazine, a container attached to a back side of the magazine, and a modular insert configured to fixedly fit within the container and in one embodiment having an opening therein sized to receive an electrical device.

Various aspects and features of the disclosure are described in further detail below.

BRIEF DESCRIPTION OF THE DRAWINGS

FIG. 29A represents a first view of a pouch system in a vertical orientation with belt mount;

FIG. 29B is a second view of a pouch system in a vertical orientation with belt mount;

FIG. 29C shows a third view of a pouch system in a vertical orientation with belt mount;

FIG. 30A represents a first view of a pouch system in a horizontal orientation;

FIG. 30B is a second view of a pouch system in a horizontal orientation;

FIG. 30C shows a third view of a pouch system in a horizontal orientation;

FIG. 31A illustrates a first view of a pouch system in a horizontal orientation;

FIG. 31B is a second view of a pouch system in a horizontal orientation;

FIG. 31C shows a third view of a pouch system in a horizontal orientation;

FIG. 32A is an exploded view of a modular pouch system;

FIG. 32B is a second view of a modular pouch system;

FIG. 32C shows a third view of a modular pouch system;

FIG. 35A shows a first view of a pouch system in a horizontal orientation with the secondary opening flap open;

FIG. 35B is a second view of a pouch system in a horizontal orientation with the secondary opening flap open;

FIG. 35C shows a third view of a pouch system in a horizontal orientation with the secondary opening flap open;

FIG. 36A illustrates a first view of a pouch system in a horizontal orientation with the secondary opening flap closed;

FIG. 36B is a second view of a pouch system in a horizontal orientation with the secondary opening flap closed;

FIG. 36C shows a third view of a pouch system in a horizontal orientation with the secondary opening flap closed;

FIG. 37A represents a first view of a pouch system in a horizontal orientation with the secondary opening flap closed;

FIG. 37B is a second view of a pouch system in a horizontal orientation with the secondary opening flap closed;

FIG. 37C shows a third view of a pouch system in a horizontal orientation with the secondary opening flap closed;

FIG. 38A shows a first view of a pouch system in a horizontal orientation without a secondary pouch opening;

FIG. 38B is a second view of a pouch system in a horizontal orientation without a secondary pouch opening;

FIG. 38C shows a third view of a pouch system in a horizontal orientation without a secondary pouch opening;

FIG. 40A is a first view of pouch system in a horizontal orientation without a secondary pouch opening;

FIG. 40B is a second view of a pouch system in a horizontal orientation without a secondary pouch opening;

FIG. 40C shows a third view of a pouch system in a horizontal orientation without a secondary pouch opening;

FIG. 41A illustrates a first view of a pouch system in a horizontal orientation with a smartphone inserted; and FIG. 41B is a second view of a pouch system in a horizontal orientation with a smartphone inserted.

DETAILED DESCRIPTION

Figure 1A:
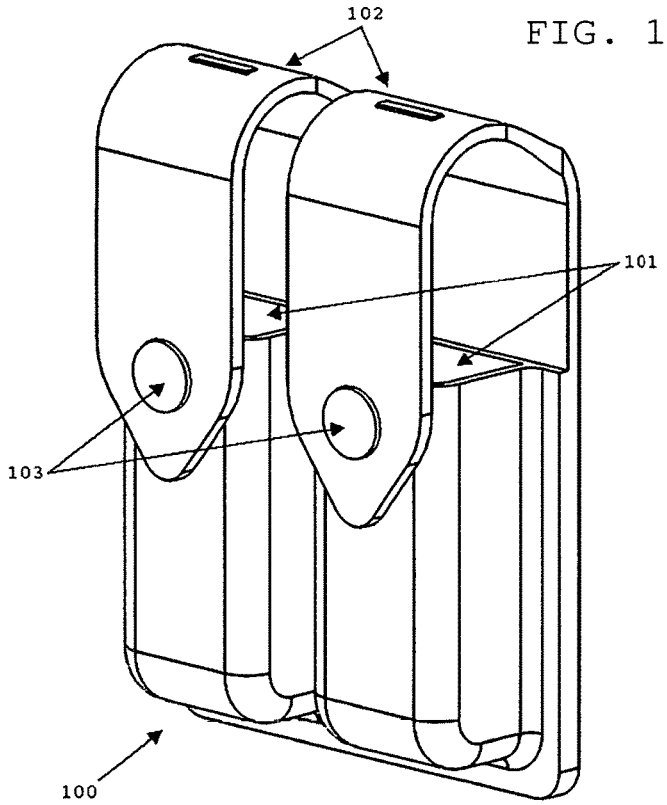
FIG. 1A shows an example of a standard ammunition pouch with retention flaps.

According to the present design, there is provided an apparatus with a plurality of pouches and receptacles configured to provide multiple capabilities. Each receptacle provided can be utilized for separate purposes, increasing the utility of the pouches and device while not adversely impacting the space needed to carry equipment. In various aspects, the pouch system may have an open or closed top, where a closed top results in an enclosed system providing both security and weatherproofing or protection from items inadvertently falling out or being unintentionally removed.

The present disclosure employs certain terminology understood or understandable to one skilled in the art and is intended to be interpreted broadly. For example, this disclosure identifies a duty belt and a gun belt which are intended to be interpreted broadly and mean a belt worn by appropriate users or personnel. Further, recitation of words such as "circuitry" or "connections" are intended to broadly mean any type of electrical hardware appropriate based on implementation. Terms such as "officer" are employed and are intended to broadly encompass a peace officer, security officer, military personnel or other interested individuals. Other examples will be understood to those skilled in the art but the language employed herein is intended to be broadly interpreted.

A secondary pouch may be provided with the primary pouch receptacle. The secondary pouch may hold various items of equipment such a smartphone, recording device, or other items. The device may incorporate a modular insert system (MIS) inserted into the secondary pouch. The MIS is constructed to hold various items of equipment and can be removed and exchanged for other configurations of MIS, providing a custom fit irrespective of the item of equipment carried or capabilities desired.

The MIS may contain a battery system and circuitry with the capacity to store a cellphone, smartphone or similar computing device. This battery system could provide the capability of recharging the power sources of smartphones, cellphones or other devices while carried within the pouch system. The MIS system may also contain circuitry directed to GPS, commercial wireless, Bluetooth, Wi-Fi, gunshot detection, recording systems or other functionality, which may be utilized to provide advanced body worn technology to the user. The system may also integrate this circuitry into the duty belt to which the pouch system is attached. This provides an integrated system of pouches, electronics, sensors, batteries and controls.

The design integrates an MIS into an officer's existing duty belt, providing for the integration of cellphones, electrical devices, equipment, recording devices, body worn technology and/or other items.

The current standard police duty belt consists of a belt manufactured of leather, plastics, synthetics, or in some instances other materials. The belt can be plain (smooth) or have various patterns embedded on the exterior or interior. The belt may have various technologies built in, embedded, and/or added to the outside such as wiring that connects to a wired or wireless network, infrastructure, electronics, cabling, sensors, batteries, and may include hardware, indentations, notches, or other features to accommodate items thereon. The standard duty belt may accommodate virtually any manner of low or high tech devices or systems.

A traditional law enforcement magazine pouch 100 is constructed of leather, plastic, nylon, metal or other materials and illustrated in FIG. 1A. Simply put, such a pouch holds a magazine or magazines containing rounds of ammunition. The configuration is generally oriented around one, two or more firearm magazines held inside a space 101 within the pouch. The magazines generally have an open top or closed top configuration. The magazines may be held place with a retention system or flap enclosure design 102. This prevents the magazines from falling out or being removed inadvertently. The flap enclosure design 102 may be secured via retention snaps 103, but alternately, Velcro, magnets, or any other type of securing arrangement may be employed. The magazine may be attached to the belt in a vertical, horizontal or upside position. The position indicates which side the opening of the pouch is so that magazines or other devices may be inserted or removed. In general, as used herein, any references to an "open top design" indicates the magazine pouch is positioned in a vertical position. It is understood any references to an open top design also encompasses any designs whereby the opening is horizontal or downward also.

The magazine pouch 100 is generally attached to a duty belt via belt loops, snaps, Velcro, brackets or in any other reasonable manner. The magazine pouch 100 may utilize a significant amount of space on the belt due to its large physical size.

In view of the existing magazine pouch design, there is a need for a system providing a multi tiered approach in carrying and storing equipment on a person, essentially saving space on the duty belt wherever possible. Such a modular pouch system would have the capability of accepting and carrying various but identifiable items of equipment without taking up significant additional space on a duty belt or other area on the body of the user.

Figure 1B:
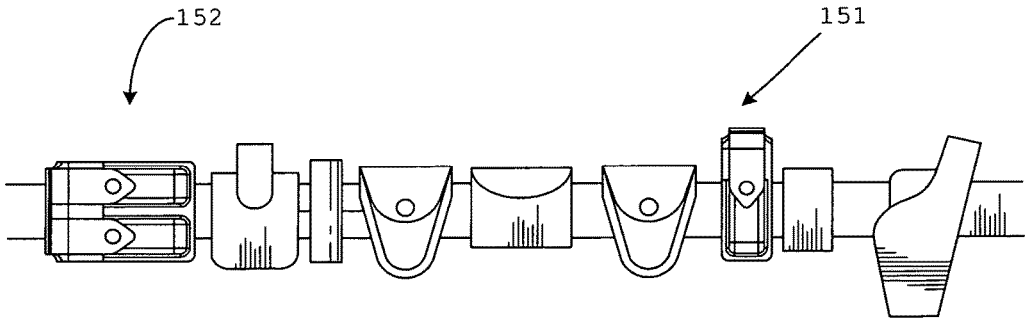
FIG. 1B is a standard duty belt worn by a police officer.

According to the present design, there is provided an enhanced design that may utilize the basic shape and construction of a traditional magazine pouch 100 similar to that depicted in FIG. 1A. The pouch 100 contains spaces for handgun magazines 101 and as noted may have an open top or closed top design. A closed top design utilizes flaps 102, panels or other designs to cover the top of the magazines in order to protect the magazines and prevent them from falling out. The flaps 102 are secured to the body of the pouch via snaps 103, Velcro, magnets, pressure or any other mechanism reasonable under the circumstances. FIG. 1B shows a typical duty belt to which the present design may be attached.

Figure 2:
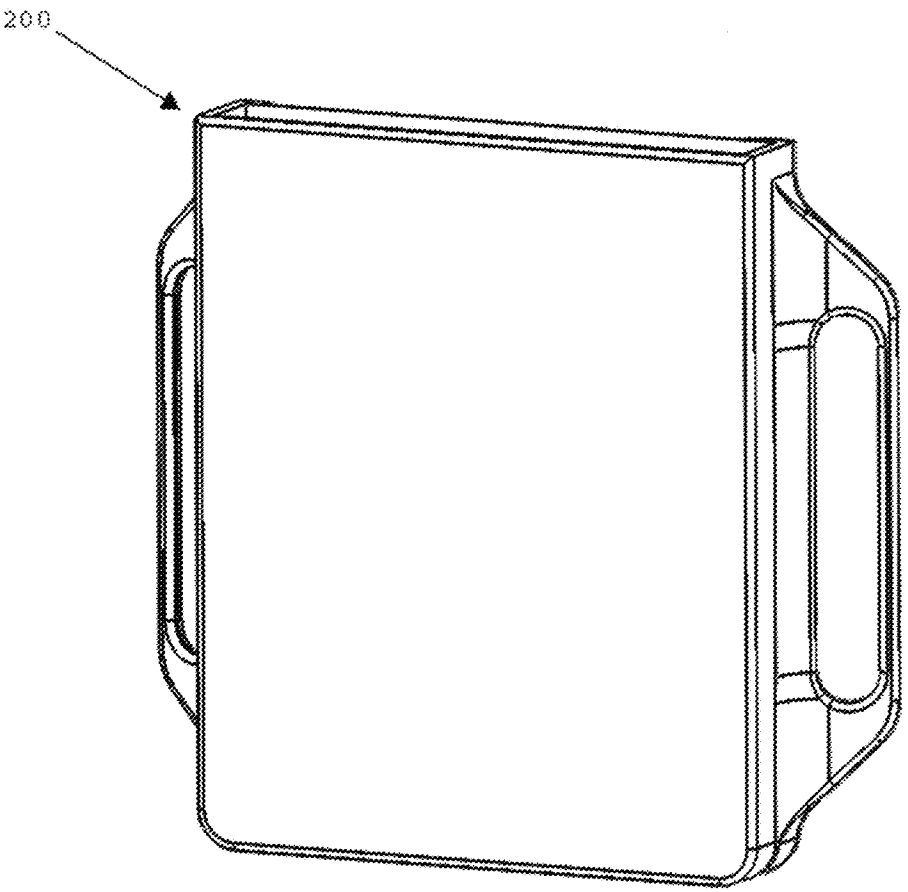
FIG. 2 is conceptual representation of a secondary pouch system with belt loops.

FIG. 2 illustrates one embodiment of the current design. From FIG. 2, the design incorporates a secondary pouch area behind, below, in front or on the sides of the pouch to hold secondary items other than handgun magazines.

Figure 3:
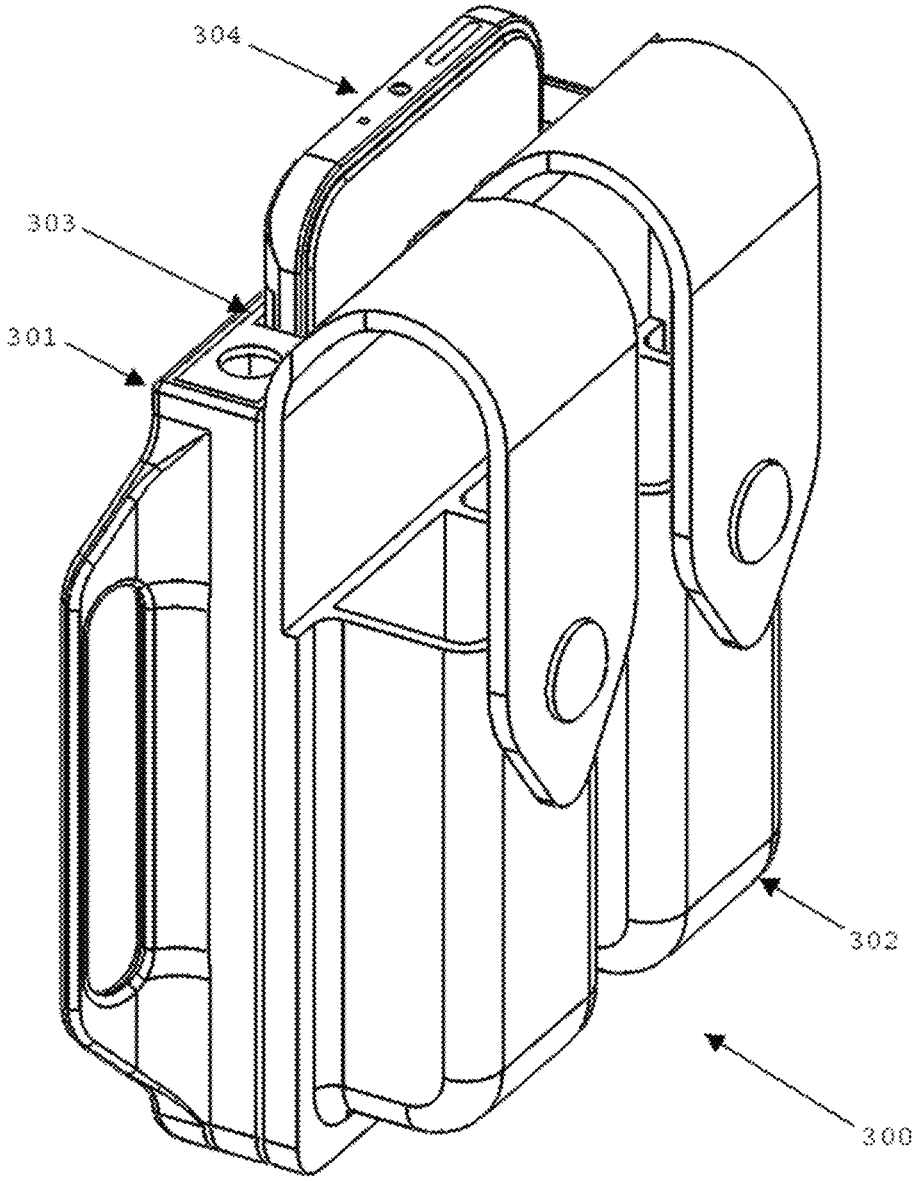
FIG. 3 is a magazine pouch attached to a secondary pouch system with an open top and a smartphone inserted into the Modular Insert System (MIS)

FIG. 3 shows use of the secondary pouch 301 as a large flat back area of the magazine pouch 302. The secondary pouch space 303 may be a purpose built area for an item, such as cellphone 304 or any other appropriate item of equipment. The secondary pouch space may employ a modular approach, i.e. include a portion, such as a center portion, that is modular in nature to accommodate different modules containing or housing different items. The secondary space 303 may include cushioning materials, spacers or brackets in order to provide a custom fit to hold specific items or equipment. The secondary pouch 301 may be constructed as an integral piece of the primary pouch 300 or it may be attached in virtually any manner known by one skilled in the art, or in some instances item(s) may be loose and/or unattached and simply fit in the secondary pouch space. If there is a physical attachment provided, this attachment may be accomplished by rivets, screws, glue, stitching, brackets, or in any other manner known in the art to bond the items together permanently or temporarily.

Figure 4A:
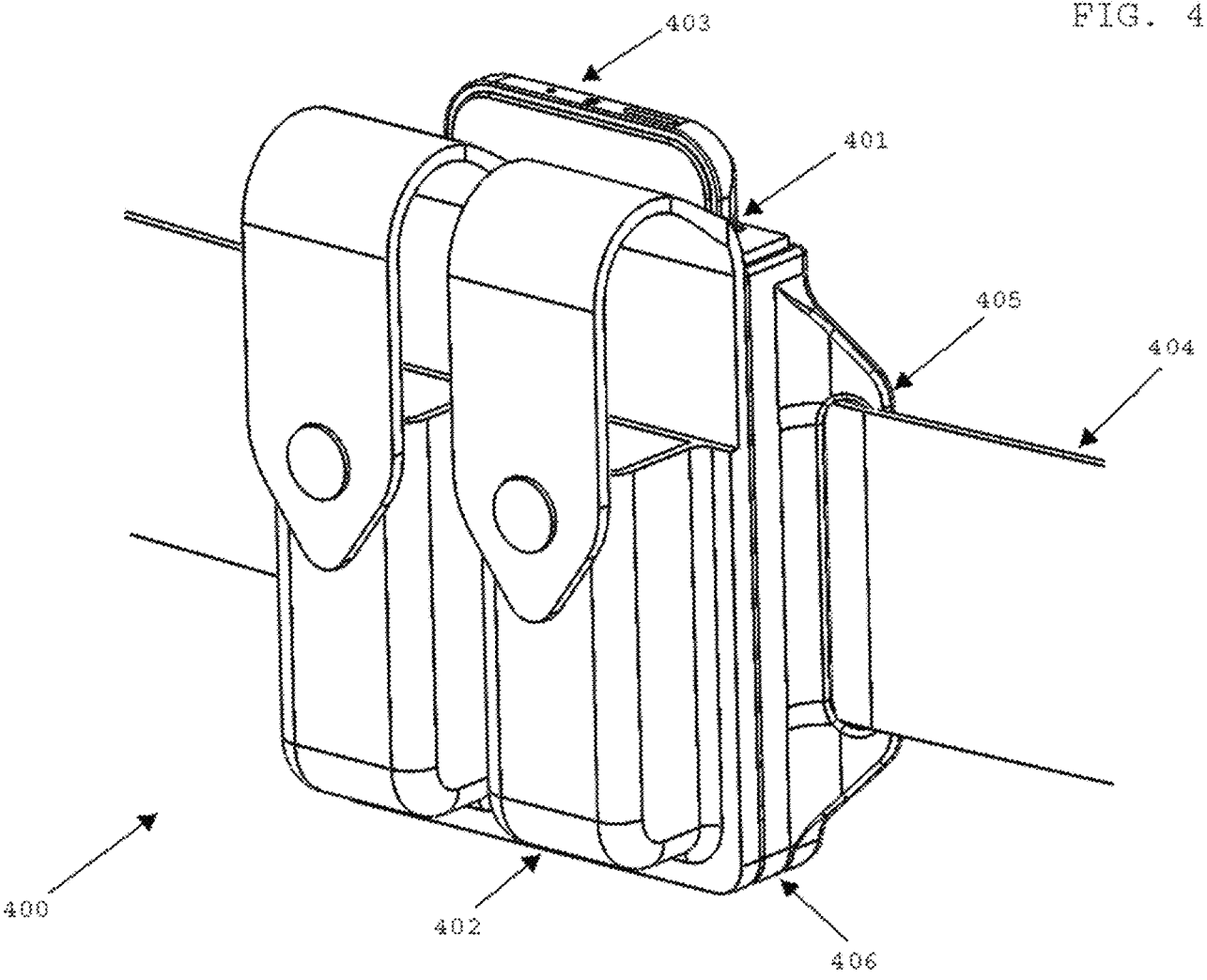
FIG. 4A shows a front view of a magazine pouch attached to a secondary pouch system with an open top and a smartphone inserted into the Modular Insert System (MIS)
Figure 4B:
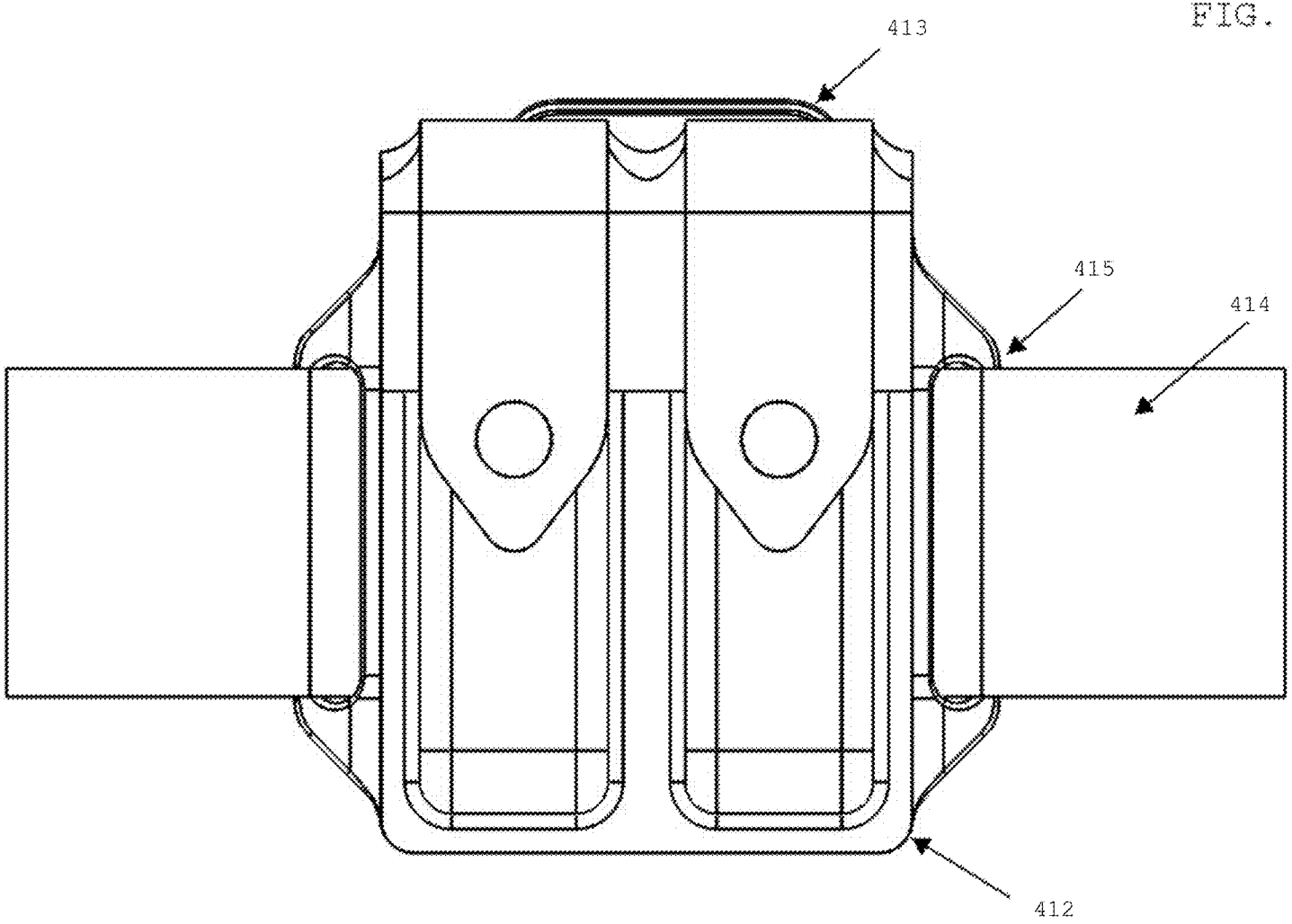
FIG. 4B illustrates a front view of a magazine pouch attached to a duty belt with a smartphone device inserted into the MIS.
Figure 4C:
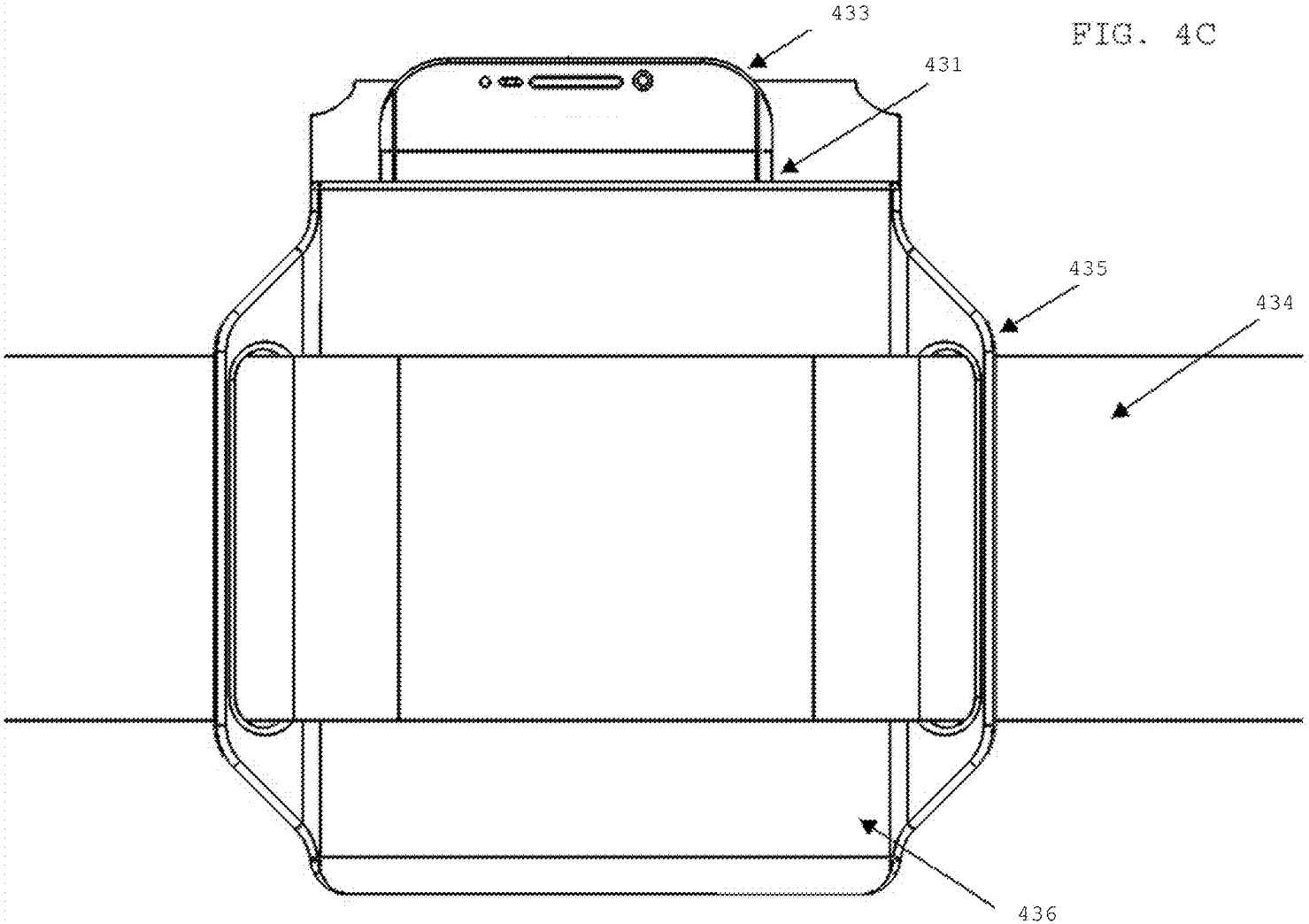
FIG. 4C illustrates a rear view of the secondary pouch system attached to a duty belt and a smartphone inserted.
Figure 4D:
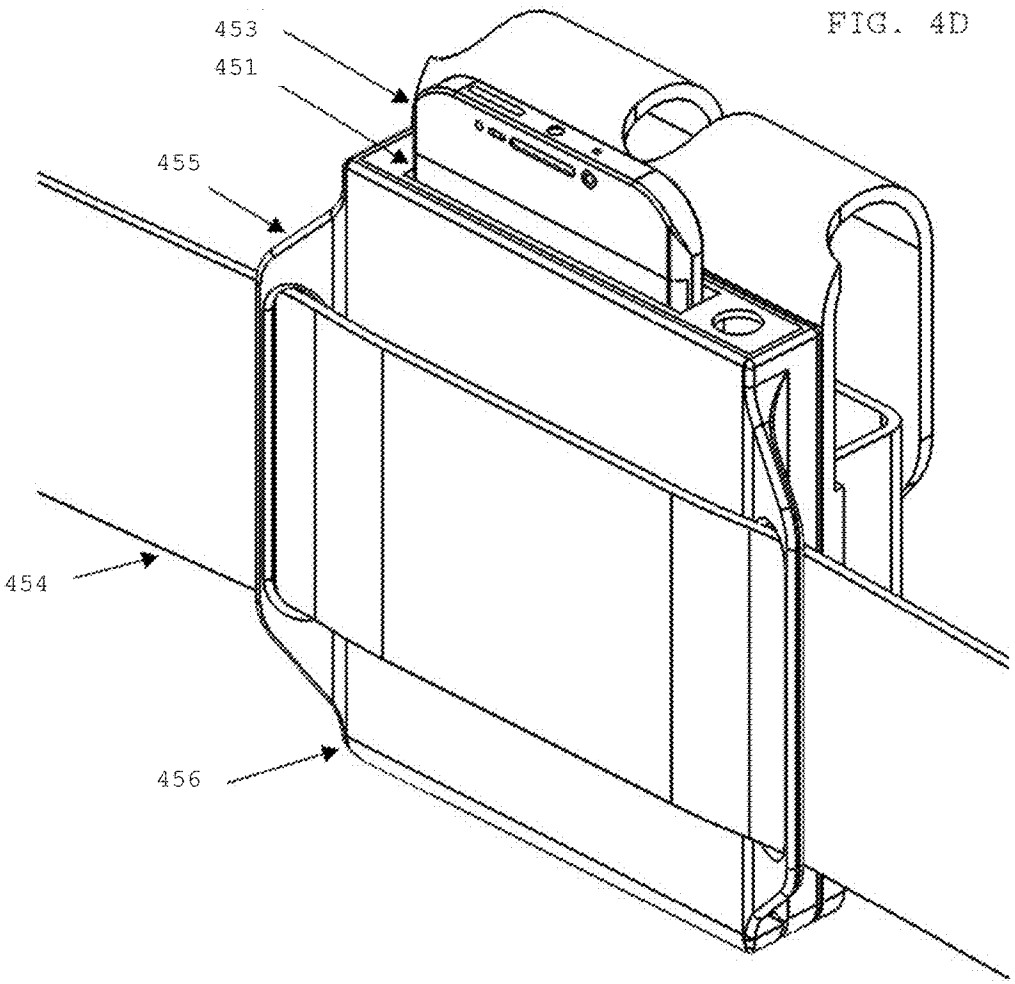
FIG. 4D shows a rear view of the secondary pouch system attached to a duty belt and a smartphone inserted.
Figure 4E:
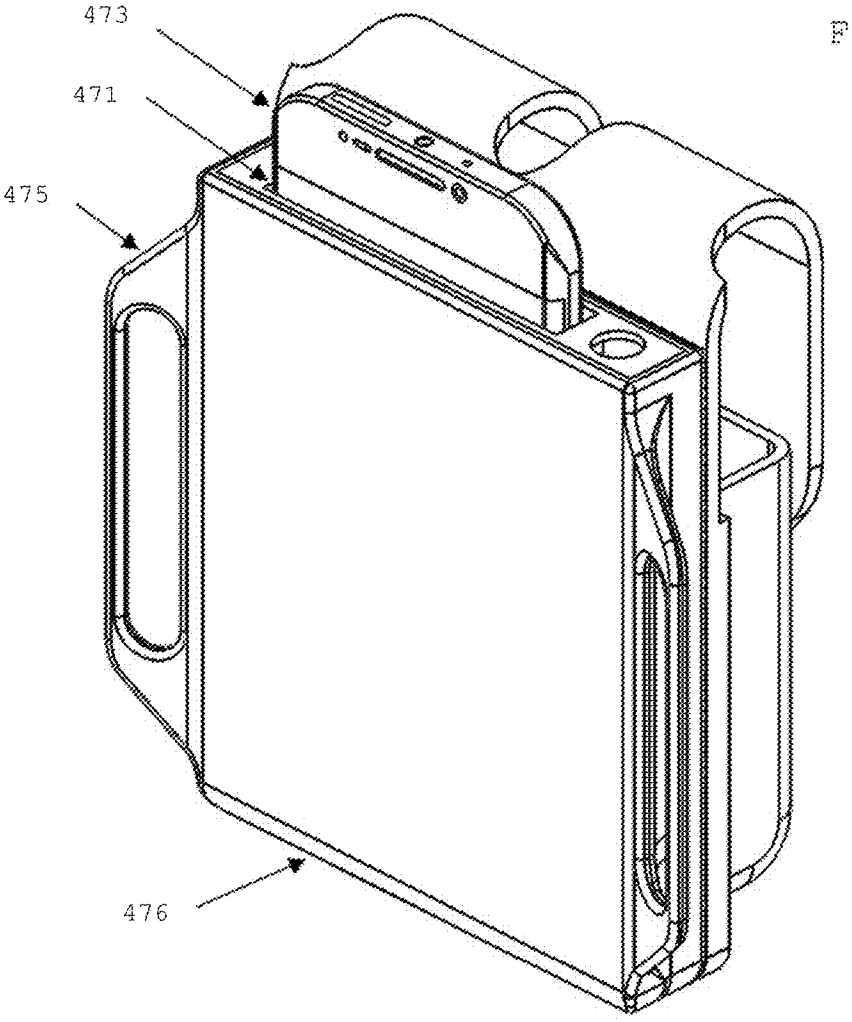
FIG. 4E shows a rear view of the secondary pouch system with a smartphone inserted.
Figure 4F:
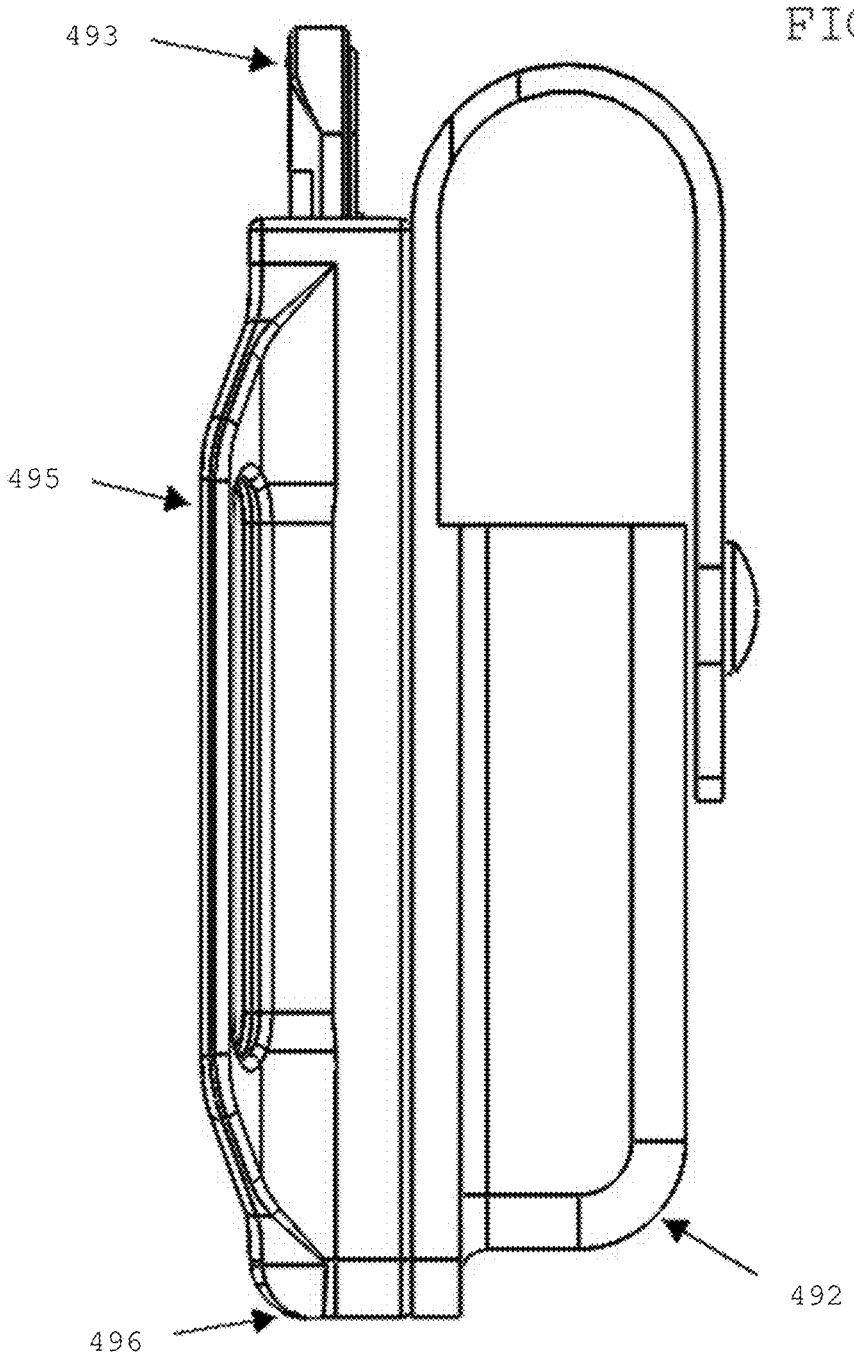
FIG. 4F represents side view of the secondary pouch system with a smartphone inserted.

FIG. 4A represents one iteration of the design wherein the secondary storage space 401 is located directly behind the magazine pouch 402. In this design, the secondary storage space 401 is shown with a smartphone 403, cellphone, or similar device inserted. The open top design may utilize any manner of internal locking or fastening systems to retain the smartphone 403. Additionally, this design may encompass a form fit so that inserted devices 403 may be held by pressure exerted. This open top design allows for easy access to the smartphone 403 or similar device. FIGS. 4A, 4B, 4C and 4D depicts the system while attached to a duty belt 404 via belt loops 405. FIGS. 4E and 4F shows a view of the rear and side views of the secondary pouch 406 and belt loops 405.

Figure 5:
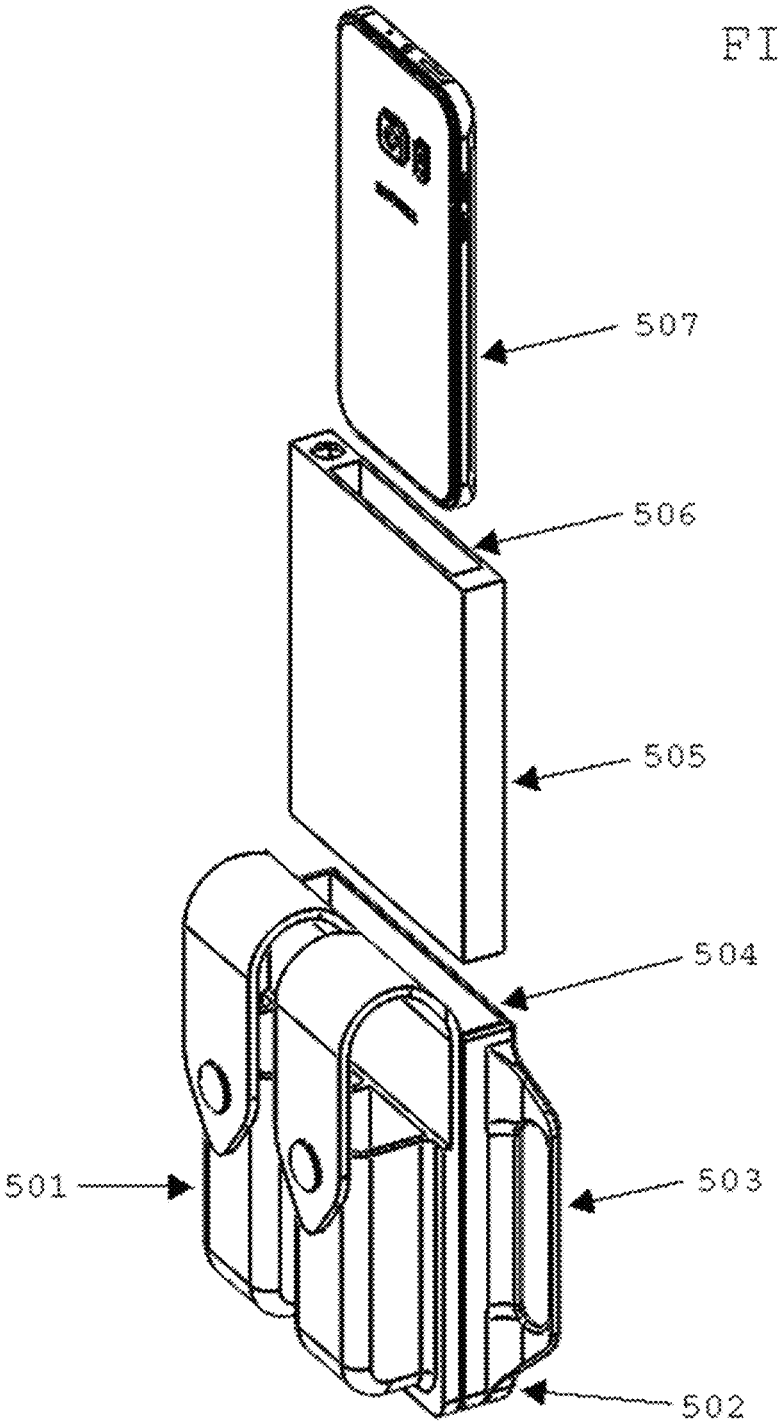
FIG. 5 shows an exploded view a magazine pouch, secondary pouch, MIS and smartphone.

FIG. 5 is an exploded view illustrating a magazine pouch 501 with a secondary pouch 502 attached to the back of the magazine pouch 501. The sides of this assembly have a belt loops 503 which allow for the attachment to a duty belt. This assembly has a large opening 504 on top of the secondary pouch 502 which allows for the insertion of various items of equipment.

The FIG. 5 representation includes a modular insert system or MIS 505. The MIS 505 is a device inserted into the opening 504 of the secondary pouch 502. The MIS 505 may be securely held or attached inside the opening 504 of the secondary pouch 502 via rails, locks, brackets, Velcro, etc. or any other type of system used to secure the device.

The MIS 505 provides a modular approach facilitating the holding or carrying of a variety of devices. FIG. 5 shows an opening 506 on the top of MIS 505. The size and configuration of the opening 506 may match the size and configuration of a smartphone 507 or other carried device, enabling the smartphone 507 or other device to be easily inserted to and removed from the opening 506 of MIS 505. This entire assembly is attached to the secondary pouch 502. However, the opening 506 of MIS 505 may be provided on the top, bottom, side or any appropriate area of MIS 505, and multiple openings or slots may be provided, particularly for maintaining larger items or items needing to be connected to other devices.

A user of the design shown in FIG. 5 may place the magazine pouch 501 and secondary pouch assembly 502 on a gun belt, i.e. a standard duty belt worn by, for example, a police officer. The MIS 505 may be inserted into the opening 504 of the secondary pouch 502 and secured in place. This combined secondary pouch 502 with belt loops 503 are attached to a duty belt and worn on the user's body on the duty belt. The user then inserts his/her smartphone 507 or other type device into the opening 506 and may remove smartphone 507 as needed.

This design provides the ability to change the MIS 505, and the item maintained therein, based on the needs of the user. By way of example and not limitation, the officer may hold some type of book or notepad, a foldable multi-tool or pocket tool, pens, GPS module or other item that could fit within the space and would not be dislodged when the user is seated, or running, or engages in a normal or expected activity that could cause the item to fall from the MIS. The MIS 505 is thus a modular device which can be changed by the user depending on the type of equipment or device stored therein. The MIS 505 system allows the secondary pouch 502 to be custom configured quickly while utilizing the same basic shell pouch regardless of the equipment carried.

Figure 6:
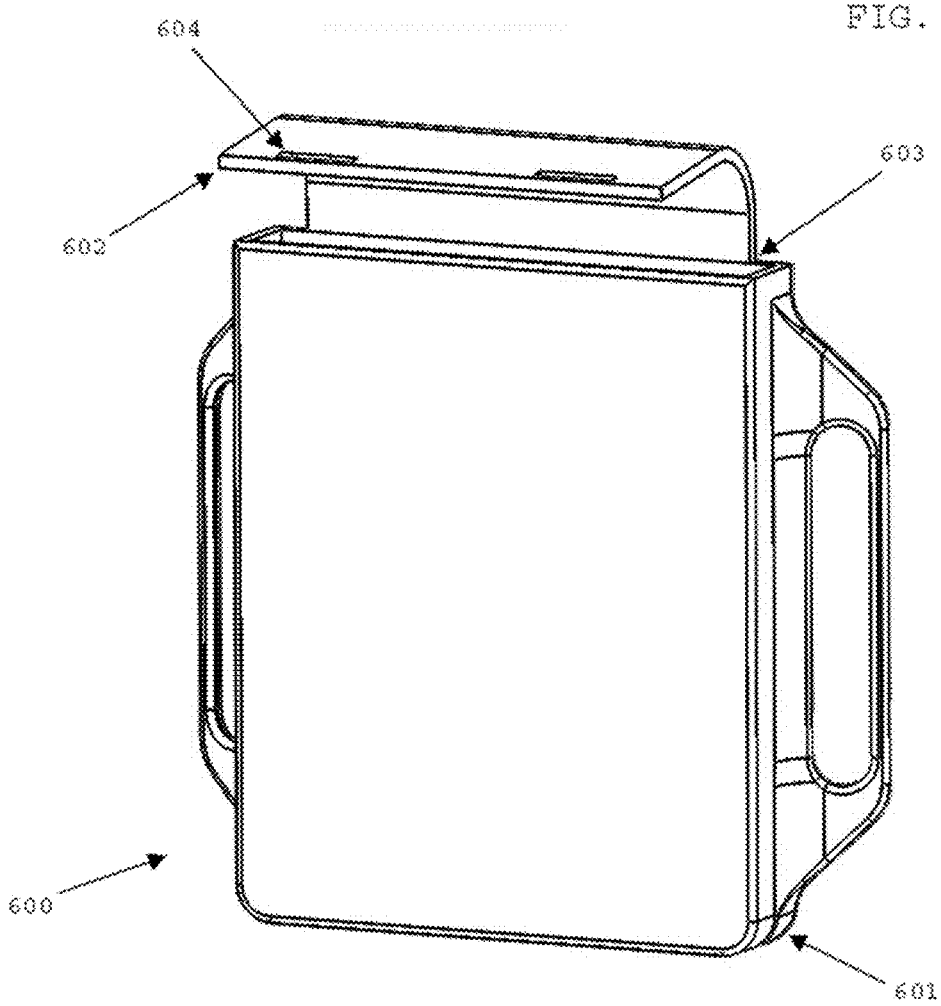
FIG. 6 shows a secondary pouch system with top flap.

FIG. 6 is an alternate variation of the design 600 wherein the secondary pouch 601 has a flap 602 covering opening 603. The flap 602 may have magnetic closing elements such as magnetic element 604, but the system may alternately employ a snap, Velcro or other closure mechanisms which serves to secure the flap 602 to the body of the magazine pouch.

Figure 7B:
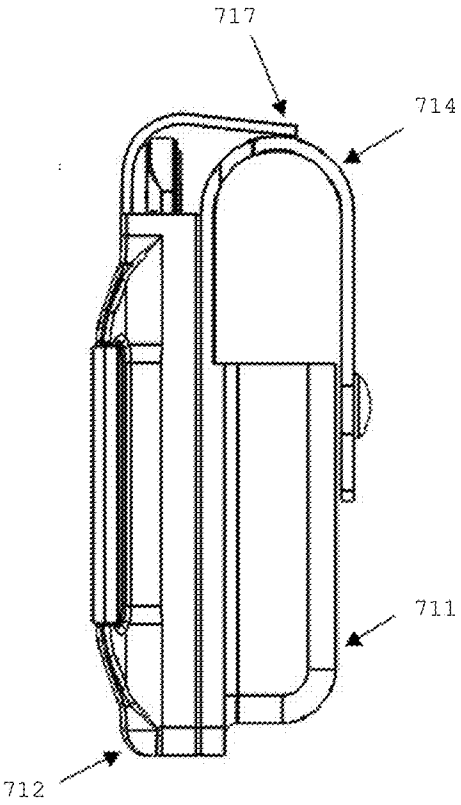
FIG. 7B illustrates a side view of a secondary pouch attached to a magazine pouch with smartphone type device inserted.
Figure 7A:
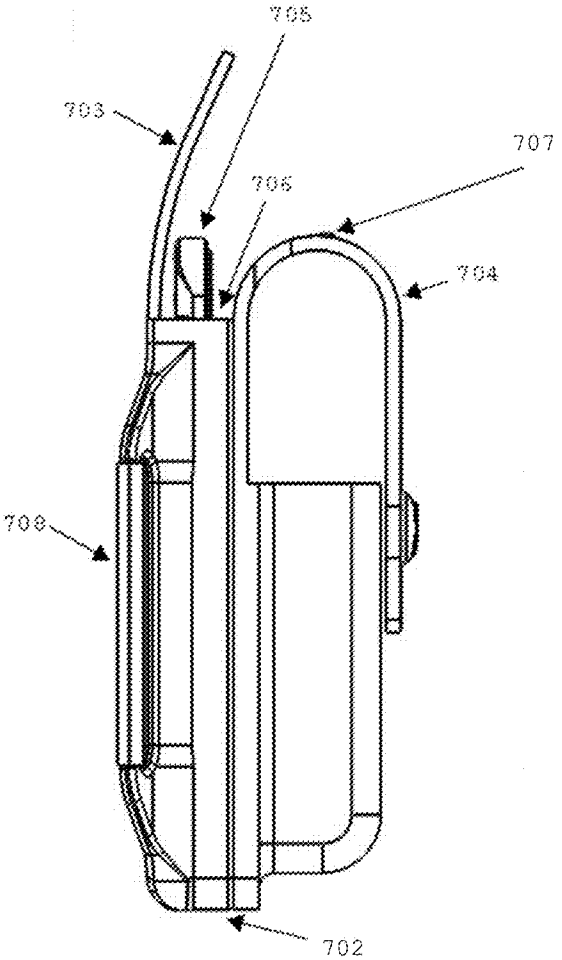
FIG. 7A is a side view of a secondary pouch attached to a magazine pouch with smartphone type device inserted, with the secondary flap open and closed.
Figure 7D:
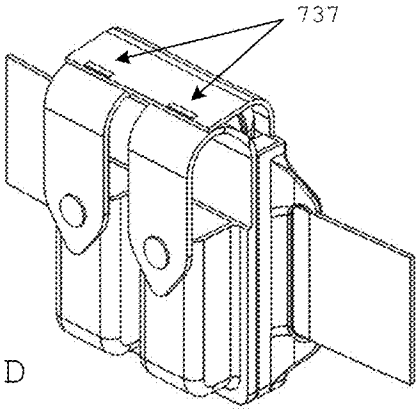
FIG. 7D shows a perspective view of a secondary pouch attached to a magazine pouch with smartphone type device inserted.
Figure 7F:
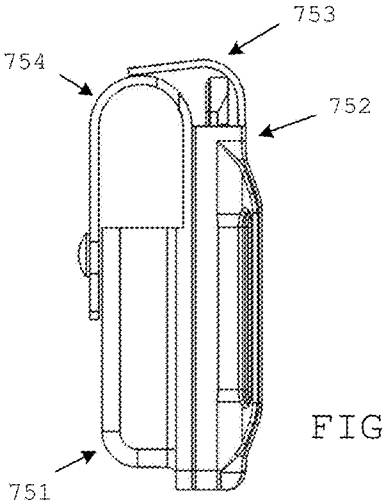
FIG. 7F shows a side view of a secondary pouch attached to a magazine pouch with smartphone type device inserted and flap closed.
Figure 7C:
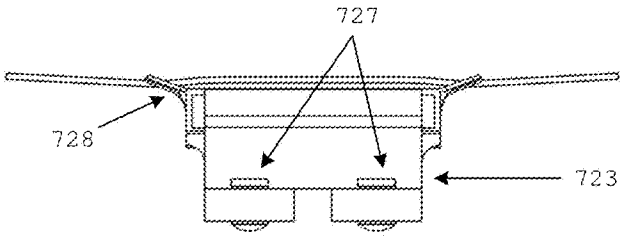
FIG. 7C illustrates a bottom view of a secondary pouch attached to a magazine pouch with smartphone type device inserted.
Figure 7E:
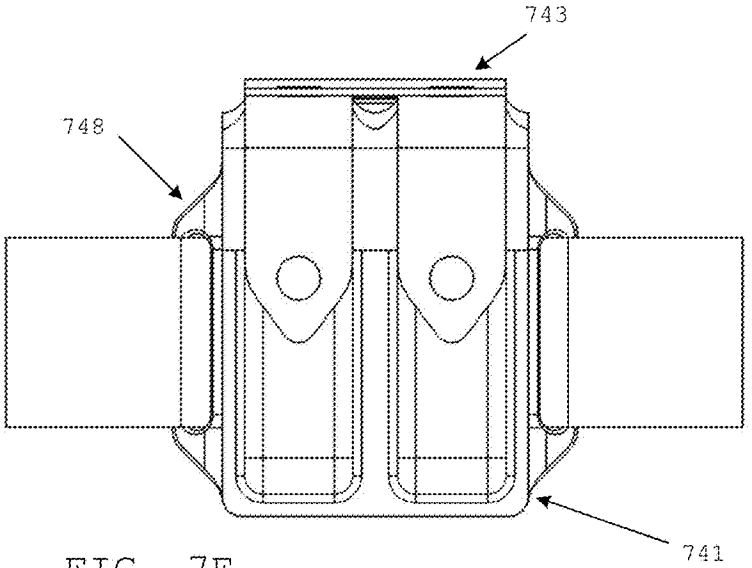
FIG. 7E is a front view of a secondary pouch attached to a magazine pouch with smartphone type device inserted.
Figure 7H:
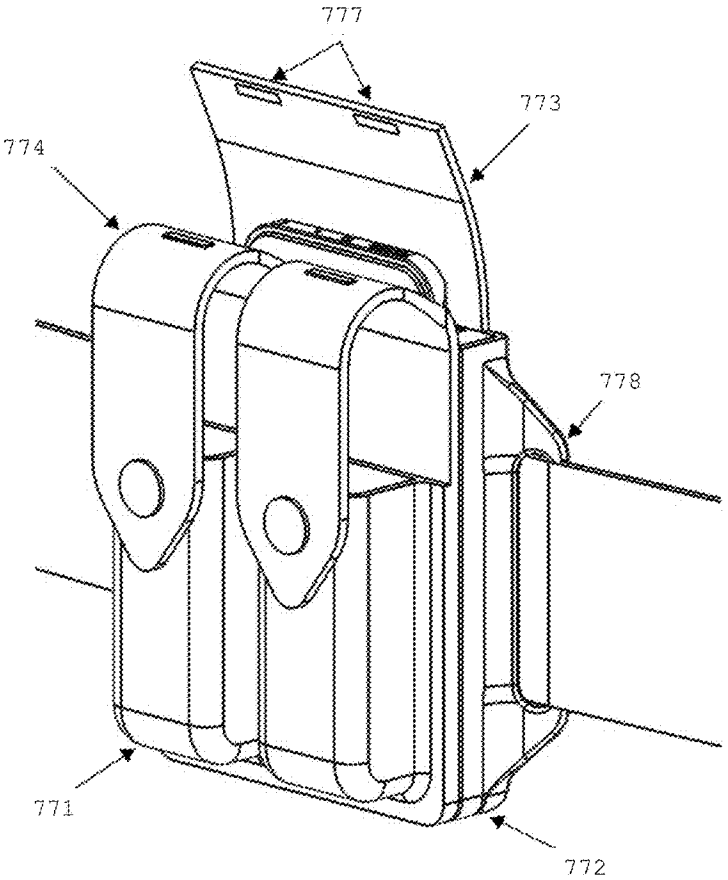
FIG. 7H represents a perspective view of a secondary pouch attached to a magazine pouch with smartphone type device inserted and flap open.
Figure 7G:
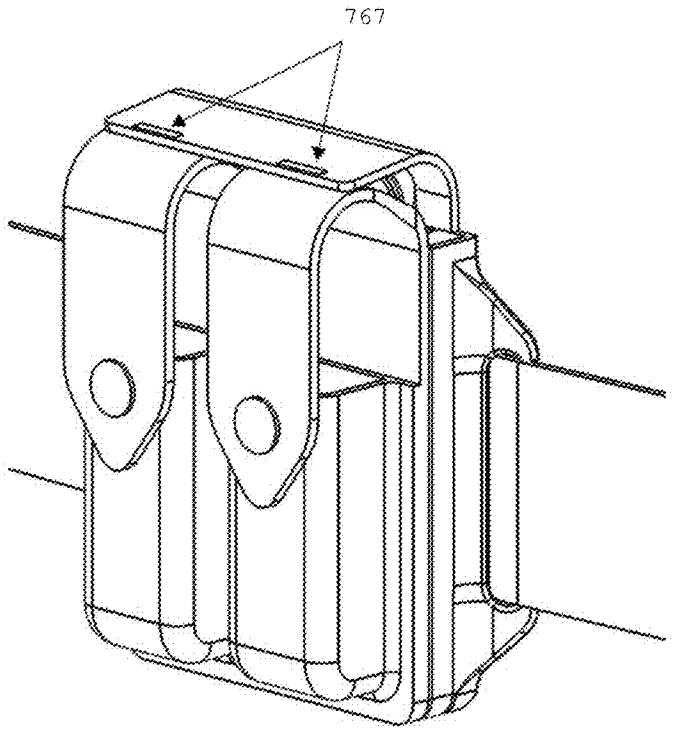
FIG. 7G is a perspective view of a secondary pouch attached to a magazine pouch with smartphone type device inserted and flap positioned over the magazine pouch.

FIGS. 7A, 7B and 7C depict a magazine pouch 701 with a secondary pouch 702 attached. Belt loops 708 are attached to the assembly. The secondary flap cover 703 opens upward and snaps closed on top of the magazine pouch flap(s) 704. The secondary flap 703 in this configuration covers any item, shown here as device 705, inserted into the MIS 706. The secondary flap 703 may be secured to the top of the magazine flap 704 again, via any appropriate device known in the art, including but not limited to magnets such as magnetic closure 707, Velcro, snap, or other means.

Figure 8B:
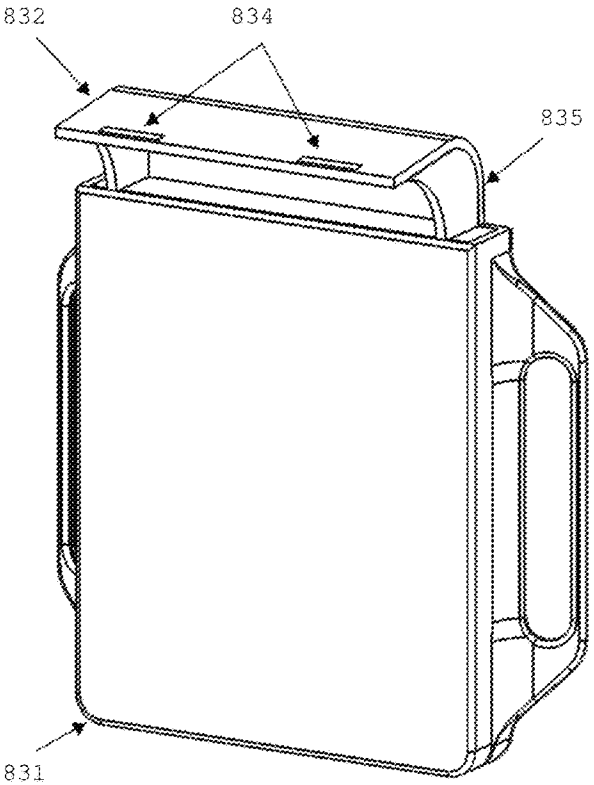
FIG. 8B is a secondary pouch with side flaps and a cover contacting the side flaps.
Figure 8A:
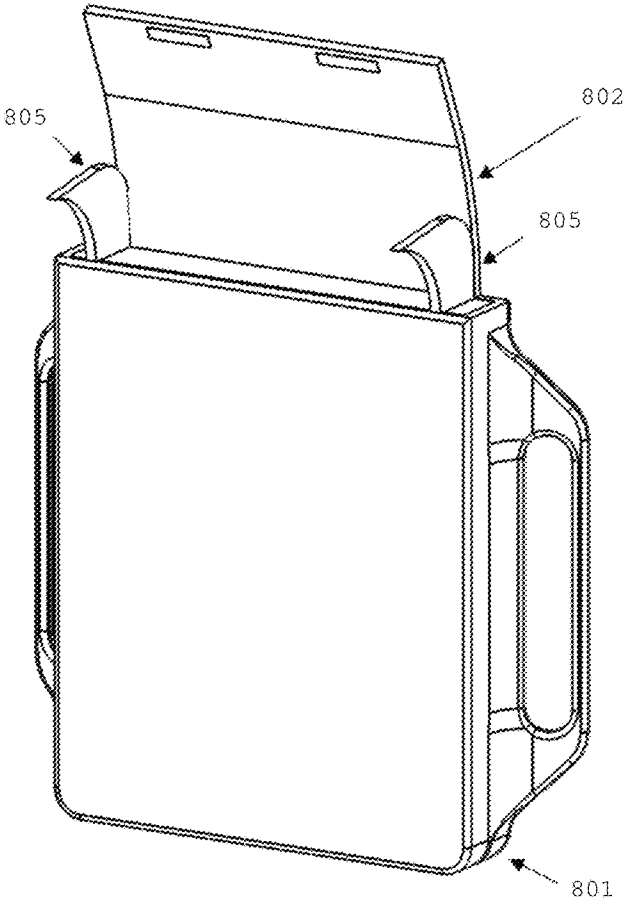
FIG. 8A shows a secondary pouch system with side flaps.
Figure 8D:
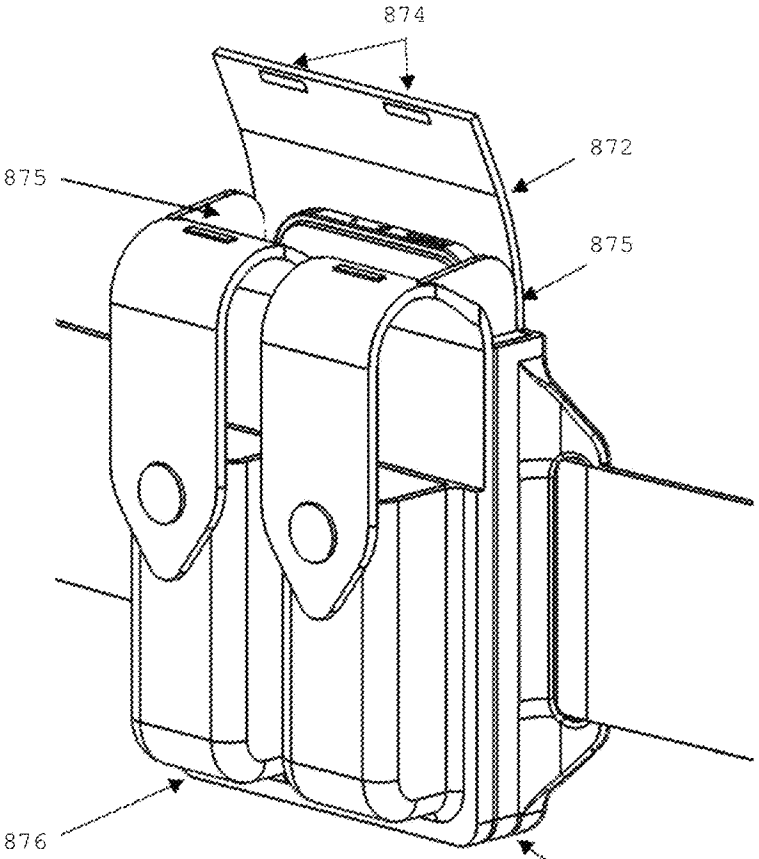
FIG. 8D shows a second view of the pouch system with side flaps and a smartphone inserted
Figure 8C:
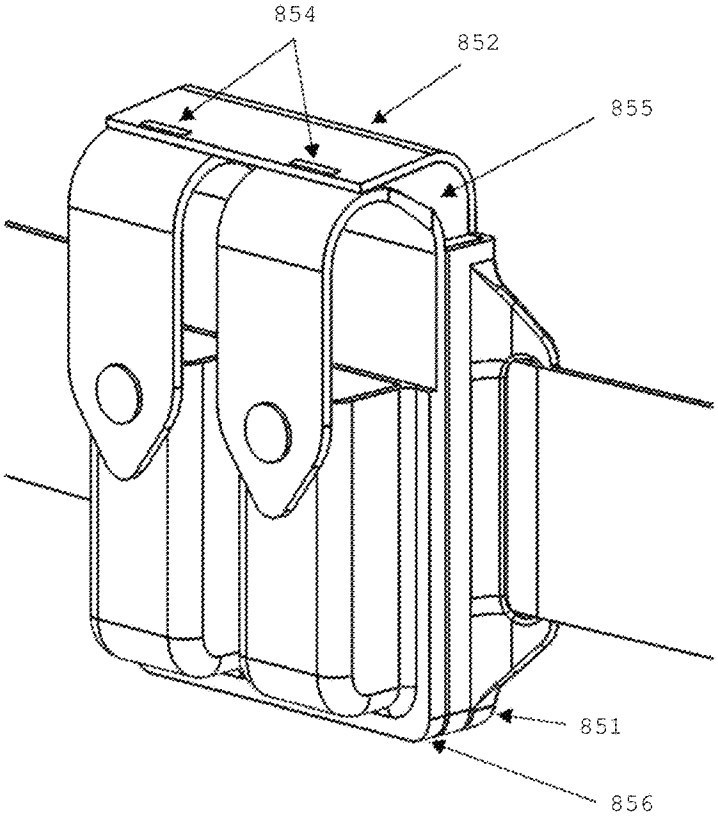
FIG. 8C illustrates a first view of the pouch system with side flaps and a smartphone inserted.

FIG. 8A and FIG. 8B show another version of the design. The secondary pouch 801 may have a flap 802 or other covering provided to cover the MIS opening 803. The secondary pouch flap 802 may have closure hardware, such as magnetic closure 804, or a snap, Velcro, or other appropriate device known in the art, securing the flap 802 to the body of the magazine pouch 806. The secondary pouch covering flap 802 may also have side covers 805 to provide additional waterproofing and security for any device stored within the secondary pouch opening 803. The side flaps 805 may be attached to the secondary flap 802 or to the body of the secondary pouch 801.

Figure 9:
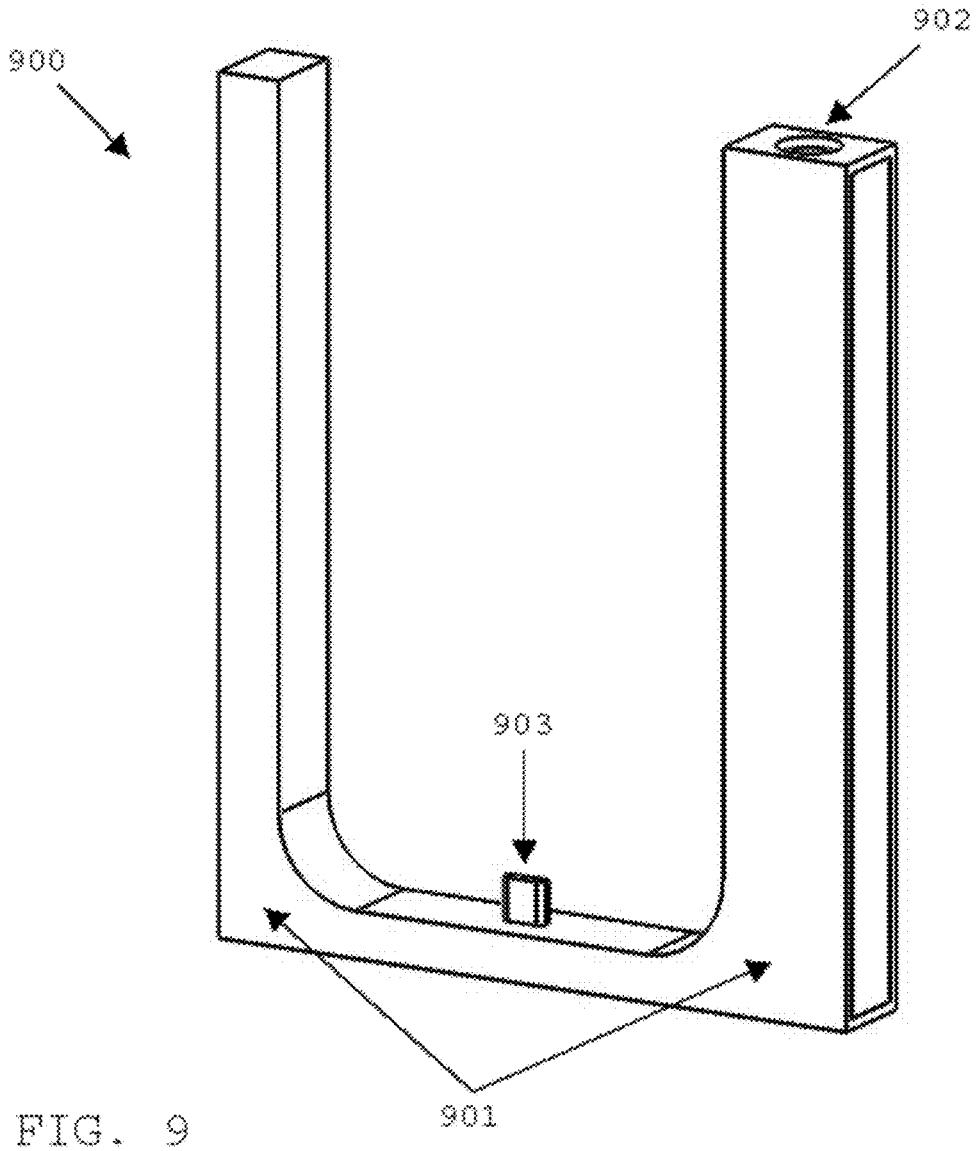
FIG. 9 shows a Modular Insert System (MIS)

FIG. 9 depicts one variation of the modular insert system (MIS). MIS 900 may be configured to house electronics, systems, batteries, etc. The MIS 900 includes a spacer component 901, in this representation a U-shaped component that may be constructed of any appropriate material (plastic, metal, etc.). The MIS 900 may also house controls such as buttons 902, LCD screens, lights, or other devices. The MIS 900 may possess circuitry and/or connections, shown in FIG. 9 such as an electrical connection 903. One skilled in the art will recognize electrical connection 903 as being a connection to a standard cell phone, smartphone or device, used to charge the phone and transmit and receive data. Electrical connection 903 allows the MIS 900 to integrate with other electronic devices. Electrical connection 903 in this configuration may be wired, wireless, or utilize any other method to connect to the device inserted into the MIS 900 to a remote device, such as via other electronics provided with, in, or on the duty belt.

Figure 10:
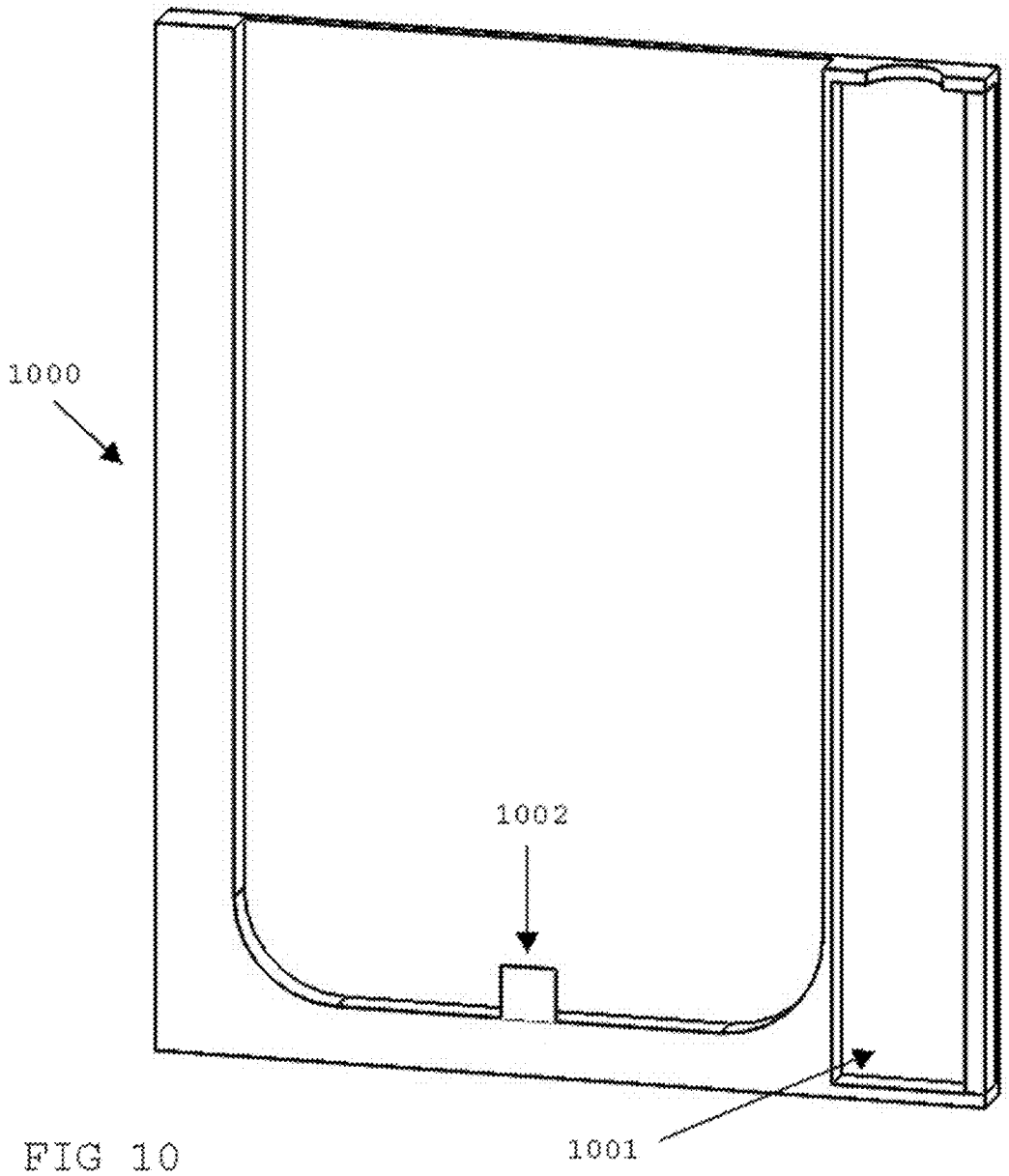
FIG. 10 shows the interior of a Modular Insert System (MIS)

FIG. 10 is a cross sectional view of an MIS 1000 similar to MIS 900 shown in FIG. 9. MIS 1000 may include a battery compartment 1001, where the battery compartment 1001 and related circuitry are connected to a port/link 1002, such as a standardized cellphone/smartphone port, i.e. a Mini B or Micro USB port or other appropriate port (Lightning, USB-C, etc.) In this design, the battery 1001 may provide back up power for any electronic device inserted into the MIS 1000 configured to receive power from the port/link 1002 provided. In certain instances, port/link 1002 may be substituted for a different style of port or link, i.e. a Mini B port may be substituted for a Micro USB port. This system may also recharge any type of device or smartphone inserted into the MIS 1000 that employs the corresponding port/link in the proper orientation. Additionally, different openings may be provided to accommodate the port/link in different positions to charge phones or devices having different receiving jack positions. In other words, the port/jack 1002 may be removable, repositionable, or may be fixedly mounted on the U-shaped piece shown in the depiction of the MIS 1000 presented in FIG. 10.

Figure 11:
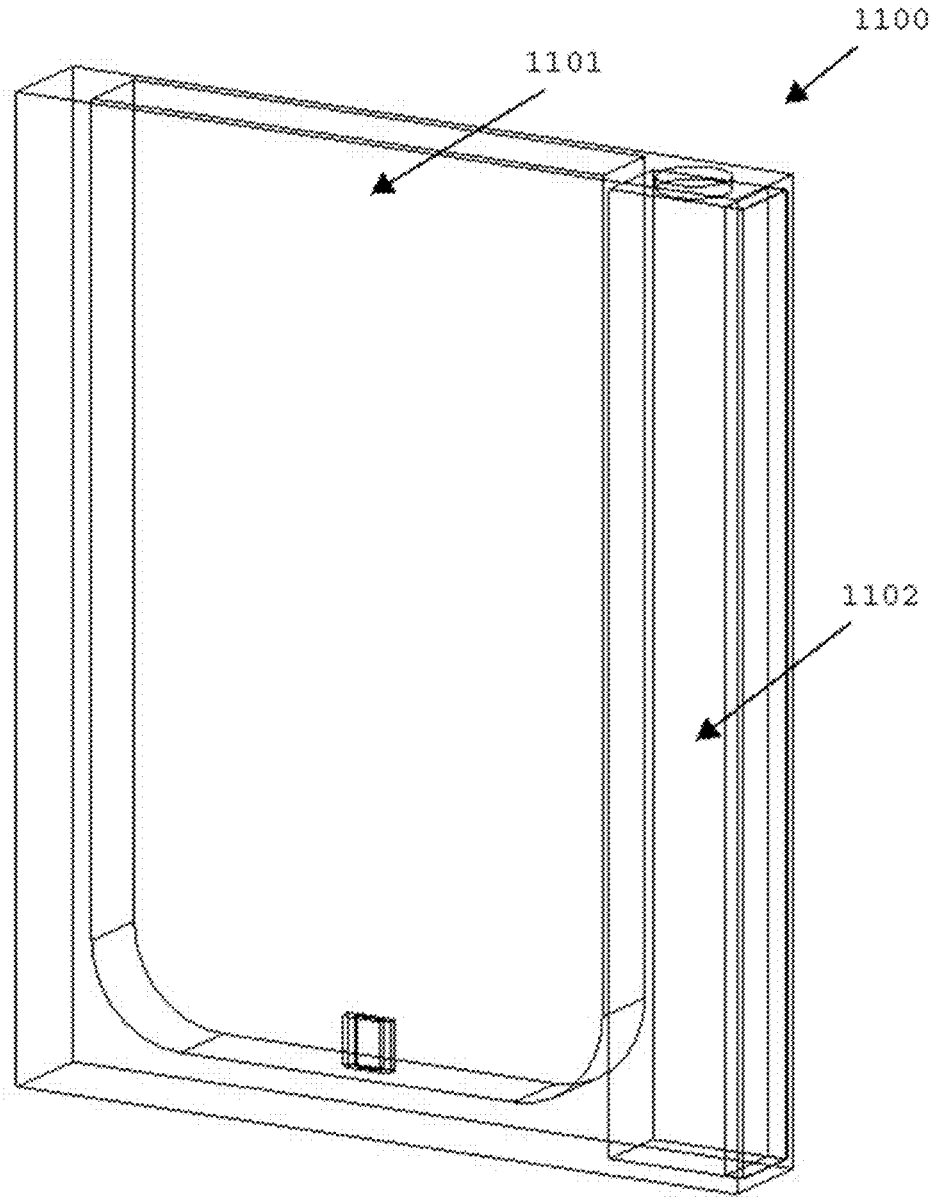
FIG. 11 also shows the interior of a Modular Insert System (MIS)

FIG. 11 shows a representation of an MIS 1100 with a representation of a smartphone 1101 inserted therein. FIG. 11 also shows an internal battery 1102, connectable to an opening 1103, which can receive an electronic cable that can either charge the internal battery 1102 or can be charged by an external device. Port 1104 represents both a male charging port provided as part of MIS 1100 and a female receiving port provided in the smartphone 1101. The internal battery 1102 may removable, replaceable or permanently attached.

Figure 12:
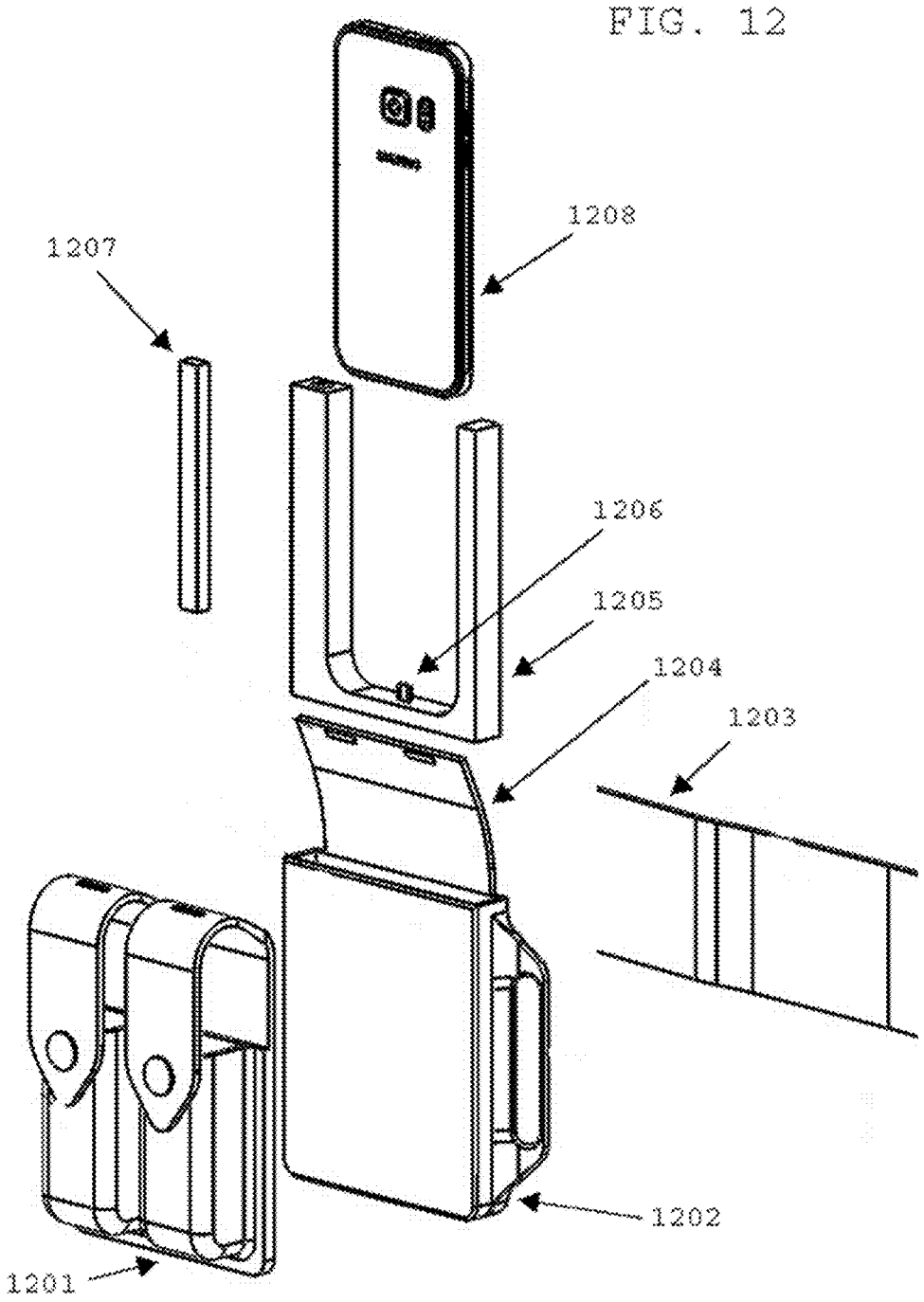
FIG. 12 is an exploded view a magazine pouch, secondary pouch, MIS, battery and smartphone.

FIG. 12 is an exploded view of one embodiment of the present design, showing a magazine pouch 1201, secondary pouch 1202, and a duty belt 1203. The depiction shows the magazine pouch 1201 detached from a secondary pouch 1202 having an open flap 1204. The MIS 1205 includes a smartphone port/link 1206 and a battery 1207 insertable into the MIS 1205. The smartphone 1208 in this arrangement may be inserted into the MIS 1205 opening and may interface with the MIS 1205 system. Battery 1207 may be used as a backup charger for a smartphone in this embodiment.

While not shown in FIGS. 9-12, electronics may be provided connecting the components shown, including, for example, from smartphone port/link 1206 to battery 1207 or to belt 1203, which is configured to receive a signal or power from the MIS. Other electronic arrangements may be provided, such as wiring, alternate power arrangements, connections and/or connectors, or other appropriate components. Further, the MIS in many representations presented herein includes equipment with connectivity to accommodate a smartphone, but again, any type MIS functionality can be provided. In its most basic form, the MIS may simply be a solid or hollow rectangular three dimensional piece, but alternately, the MIS may be a piece configured to hold a book or notepad, or a device that holds pens or other small implements, or accommodates other equipment as appropriate. In one possible embodiment, a cell phone or smart phone is merely received and maintained in the MIS with no connections or electronics provided. In short, the MIS may take virtually any form while fitting within the secondary pouch and accommodating items or even accommodating no additional items.

Figure 13:
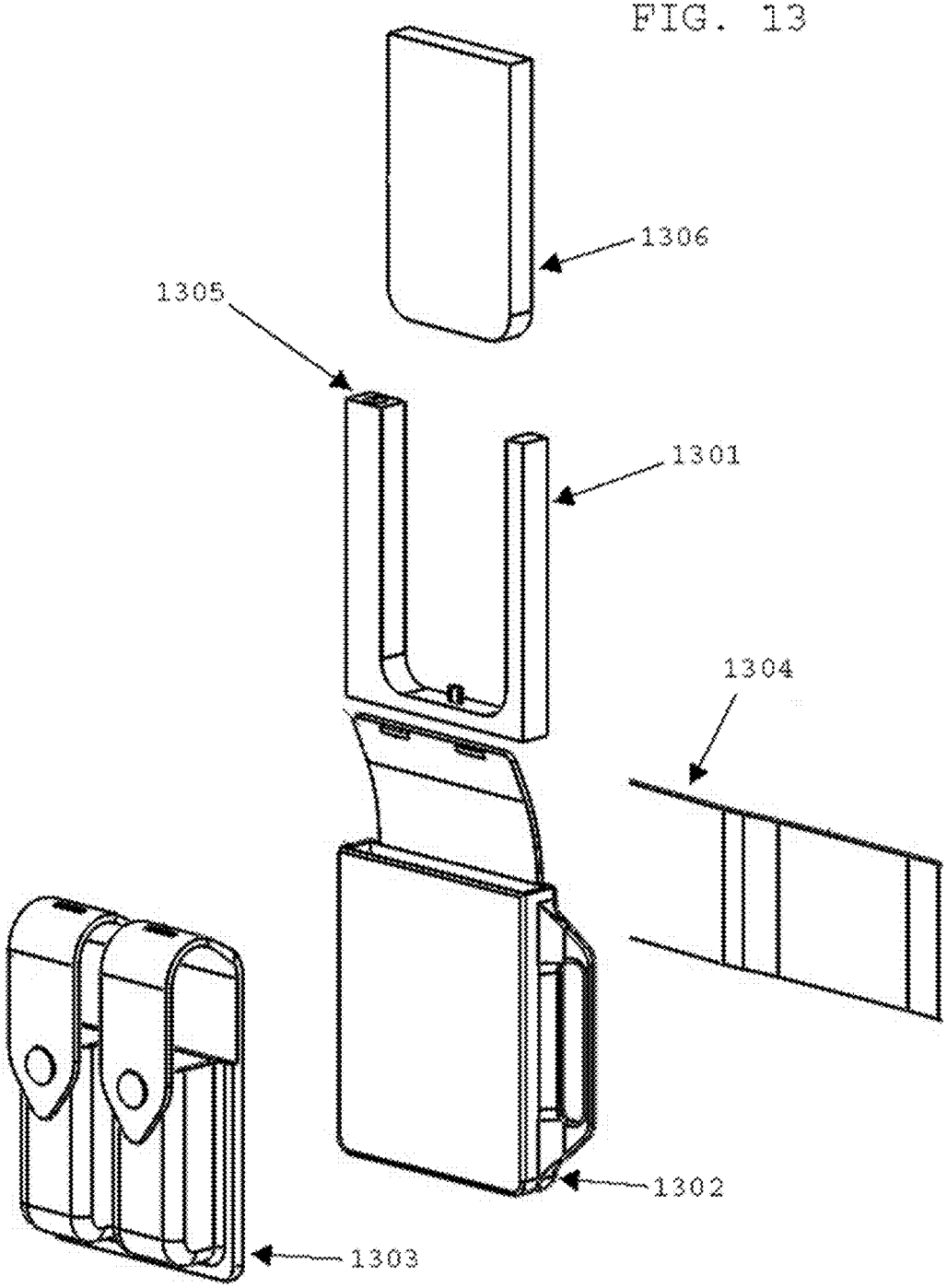
FIG. 13 shows a further exploded view a magazine pouch, secondary pouch, MIS, and processor and/or battery.

FIG. 13 shows another iteration of the design. The MIS 1301 may include circuitry that may be integrated into or through secondary pouch 1302 and magazine pouch 1303. The secondary pouch 1302 and/or the magazine pouch 1303 may include circuitry interfacing with the gun belt 1304, other pouches, and/or equipment worn by the user. This interface may be accomplished via wired, wireless, Bluetooth, Wi-Fi or any other means. The entire system including the MIS 1301 may also contain circuitry GPS recording systems or other devices which may be utilized to provide advanced body worn technology to the user, and may employ and integrate various controls, sensors, displays, and so forth. As shown in FIG. 13, an opening 1305 may be attached to provide for external control or for connection to a power source such as a battery. The system may integrate this circuitry into the duty belt 1304 upon which the pouch system 1302 is attached. While shown as an opening 1305 in FIG. 13, a button or selector may be provided with the MIS 1301 as appropriate.

FIG. 13 thus depicts a particular version of the design, which may integrate a computing device 1306 having a processor, as well as a back up battery, recording device, and other body worn technology. The design may be configured to connect together and provide a functioning computing device 1306 located in the MIS 1301, together with various controls, sensors, displays and other devices. The MIS 1301 may be designed to accept a removable battery to provide power or back up power to body worn technology and recording devices.

This application is related to U.S. patent application Ser. No. 14/620,748, entitled "Belt System for Use with Video/Audio Recording Devices," inventor Kresimir Kovac, filed Feb. 12, 2015, and the present design may be employed with a belt system as shown in the '748 application. The belt described in the '748 application acts as the backbone for a holistic system in which cameras, activation mechanisms, monitoring systems, recording devices, GPS, commercial wireless, Wi-Fi, etc. are integrated into an electronic device capable of managing the system, recording audio/video, transmitting/receiving/storing data among other capabilities.

As shown in the '748 application, various electrical connections are provided to different components in order to perform various functions, including but not limited to sensing the removal of an item housed in a container attached to the belt, integrating with a camera, and transmitting signals and/or data to a remote location. When used with the present design, as suggested herein, the MIS and included devices may serve to connect a smartphone to electronics provided on the belt, such as through or using the secondary pouch containing the MIS and smartphone.

In one instance, the duty belt may be provided with an electrical connection that is located on the outside of the belt that connects to or mates with an electrical connection provided on the belt or back side of the secondary pouch, which in turn connects through the MIS to the smartphone. In this manner, information may be received by the smartphone, including from sources such as a body camera or electrical connections and sensors detecting removal of equipment from the belt, and may be processed by the smartphone and transmitted appropriately to remote devices or be available for the duty belt wearer or other personnel to review. With many law enforcement personnel already employing a magazine or magazines on the belt, the present design provides an advanced level of functionality without significant additional space or weight being required, and further enhancing the functionality of the duty belt shown in U.S. patent application Ser. No. 14/620,748.

Figure 14:
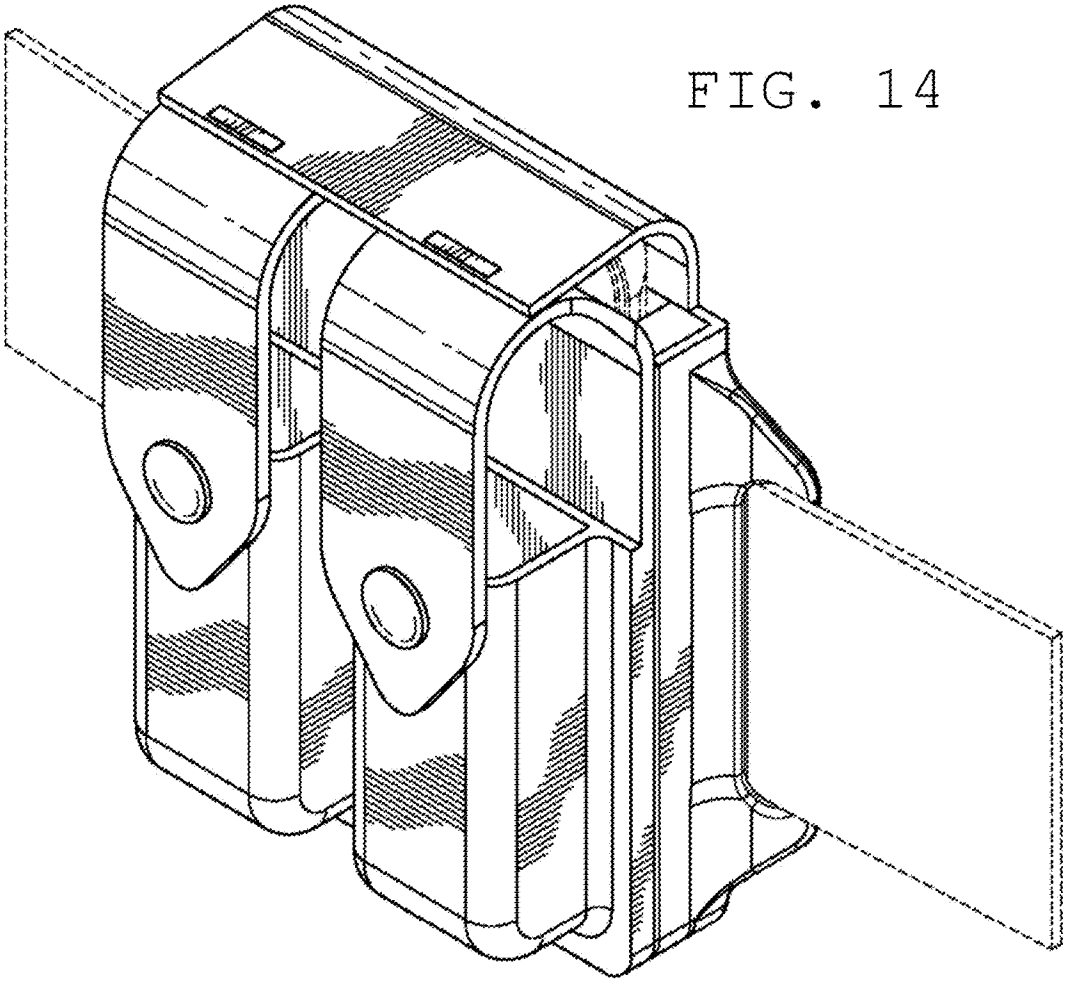
FIG. 14 illustrates a top perspective view showing the top, front, and left sides of a belt pouch having double duty capability.
Figure 15:
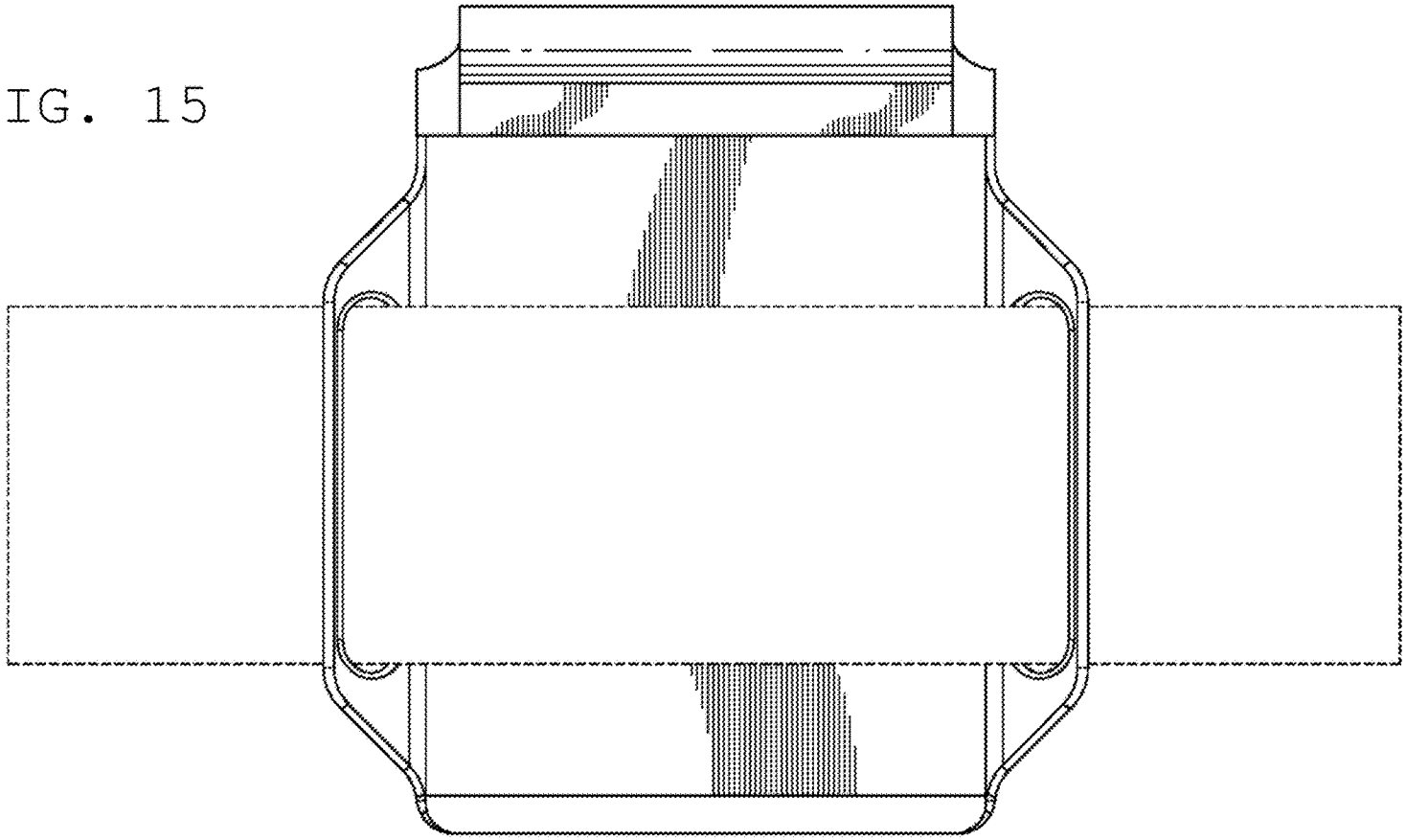
FIG. 15 is a rear view of the belt pouch having double duty capability, including a belt to which the design is attached.
Figure 16:
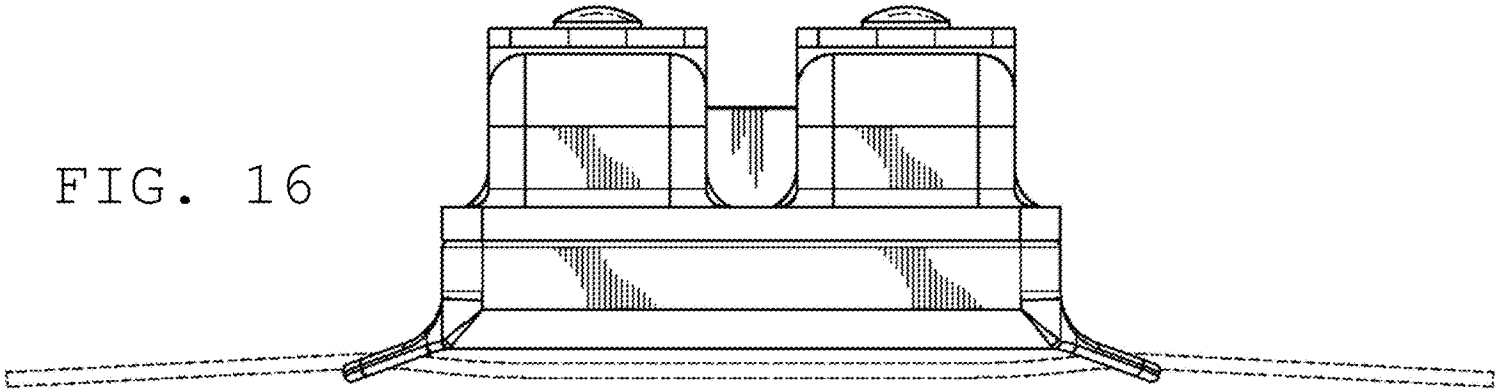
FIG. 16 is a bottom view of the belt pouch having double duty capability, including a belt to which the design is attached.
Figure 17:
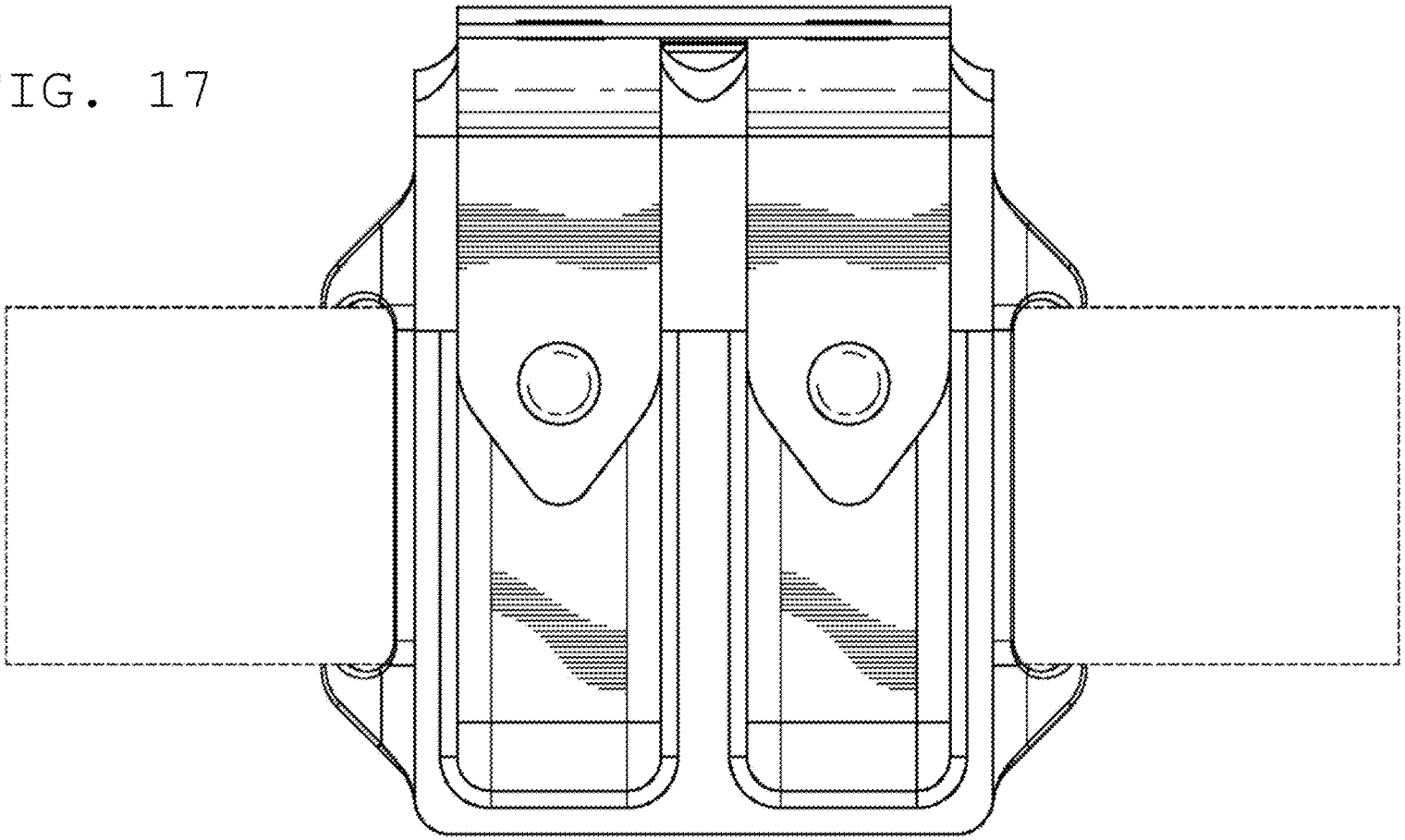
FIG. 17 is a front view of the belt pouch having double duty capability, including a belt to which the design is attached.
Figure 18:
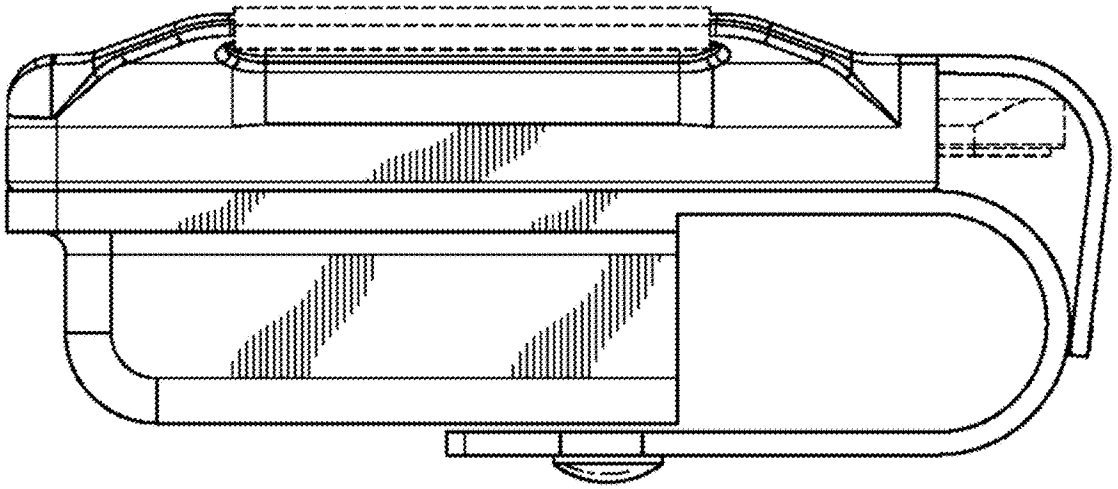
FIG. 18 is a right side plan view the belt pouch having double duty capability.
Figure 19:
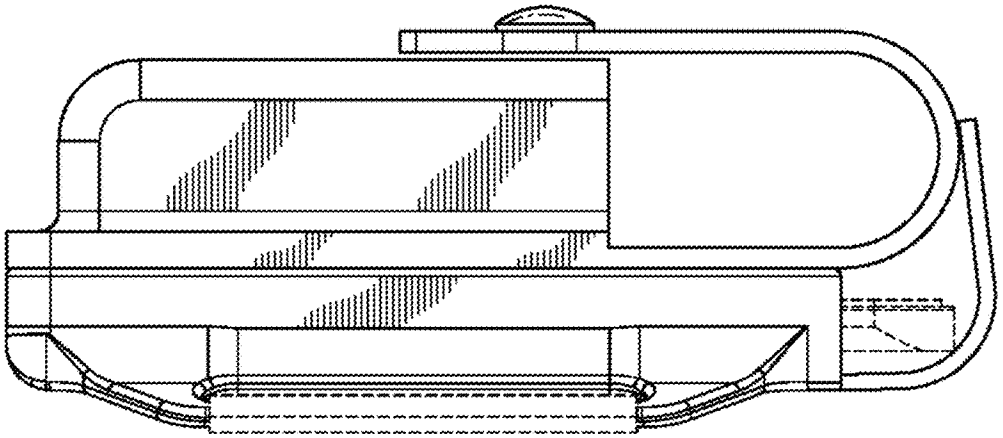
FIG. 19 is a left side plan view of the belt pouch having double duty capability including a protective flap.
Figure 20:
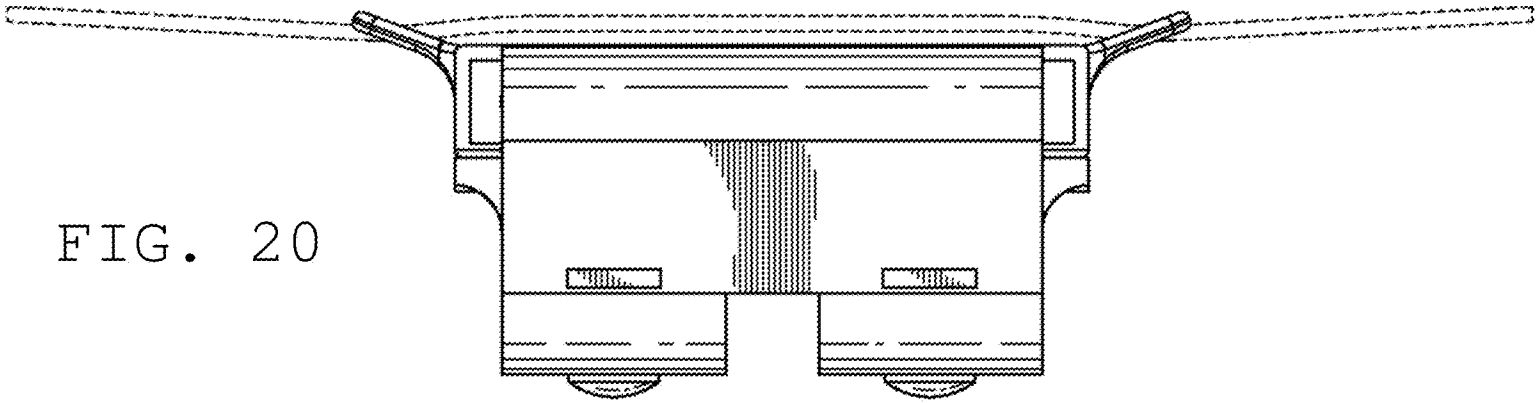
FIG. 20 is a top plan view of the belt pouch having double duty capability, including an overlaid flap and contemplating a smartphone and smartphone specific MIS provided.
Figure 21:
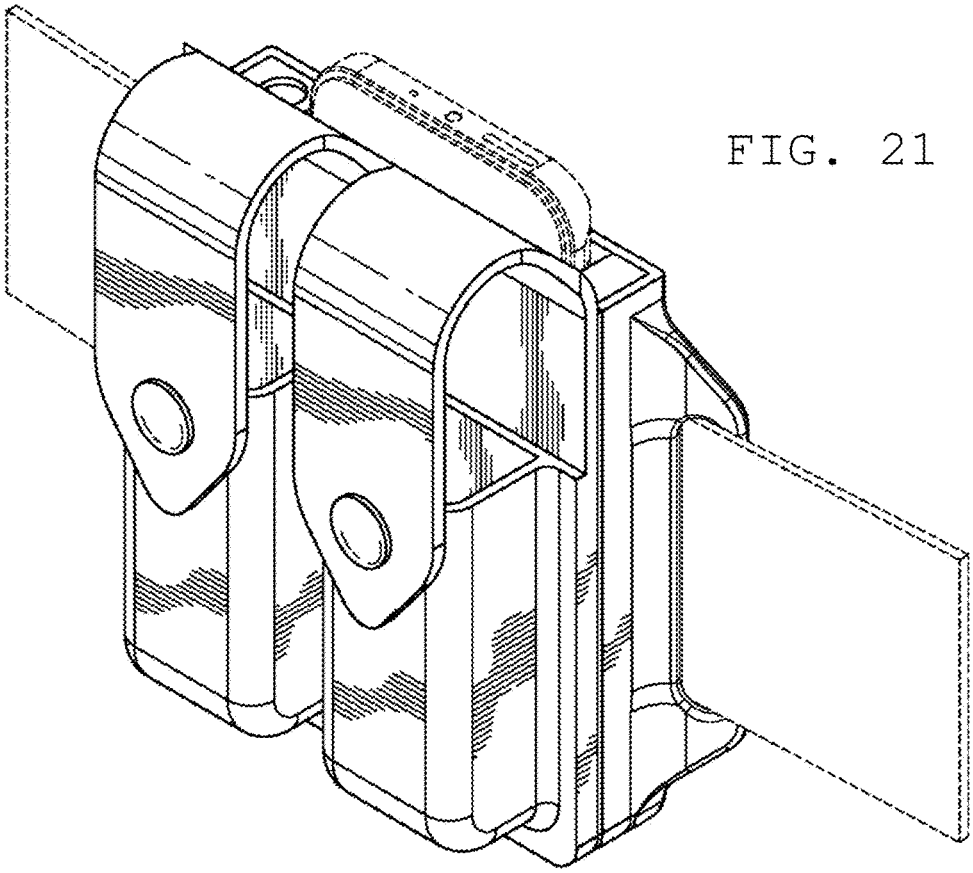
FIG. 21 illustrates a top perspective view showing the top, front, and left sides of an alternate embodiment of a belt pouch having double duty capability without a covering flap.
Figure 22:
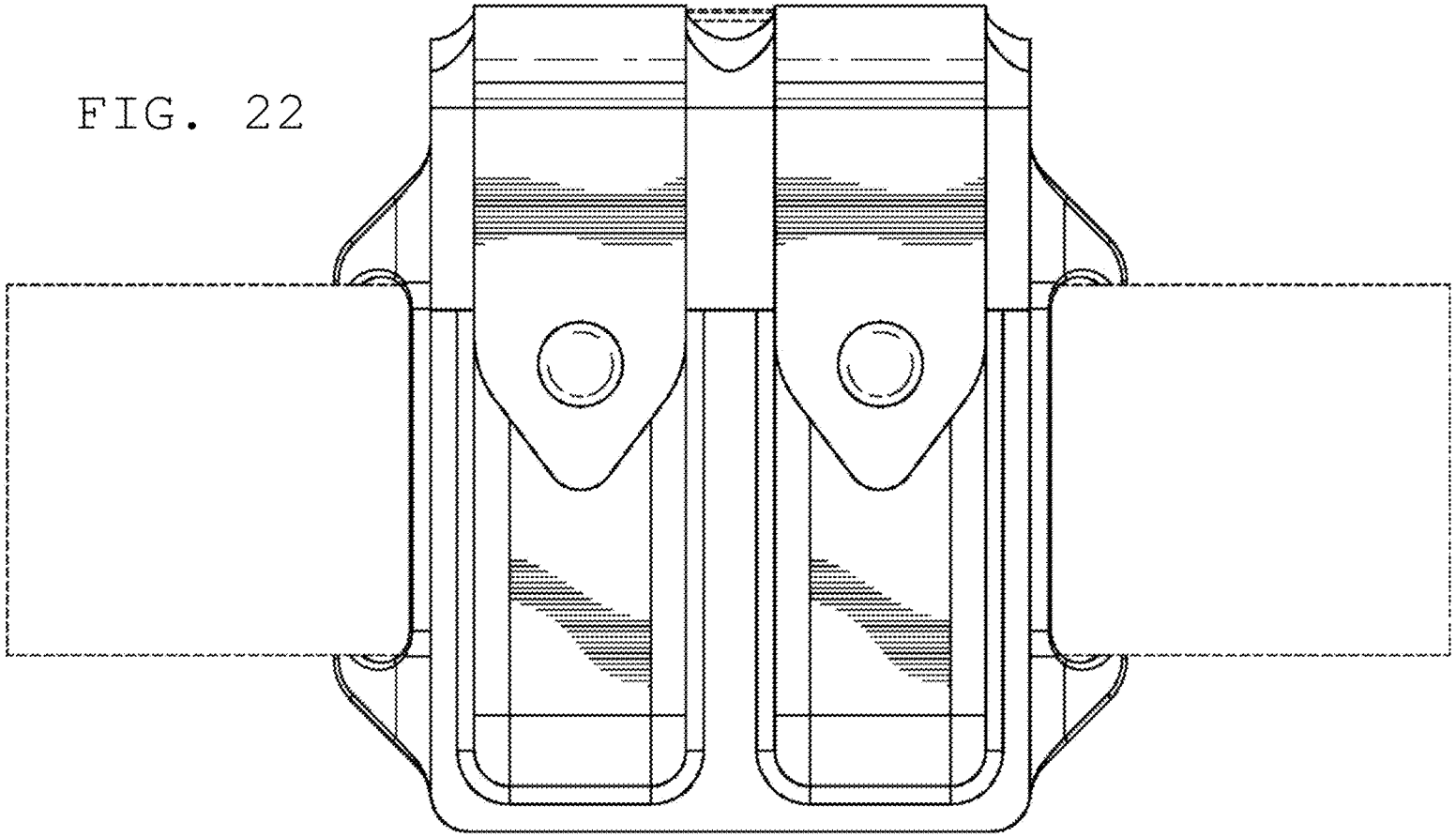
FIG. 22 is a front view of the alternate embodiment of the belt pouch having double duty capability, including a belt to which the design is attached.
Figure 23:
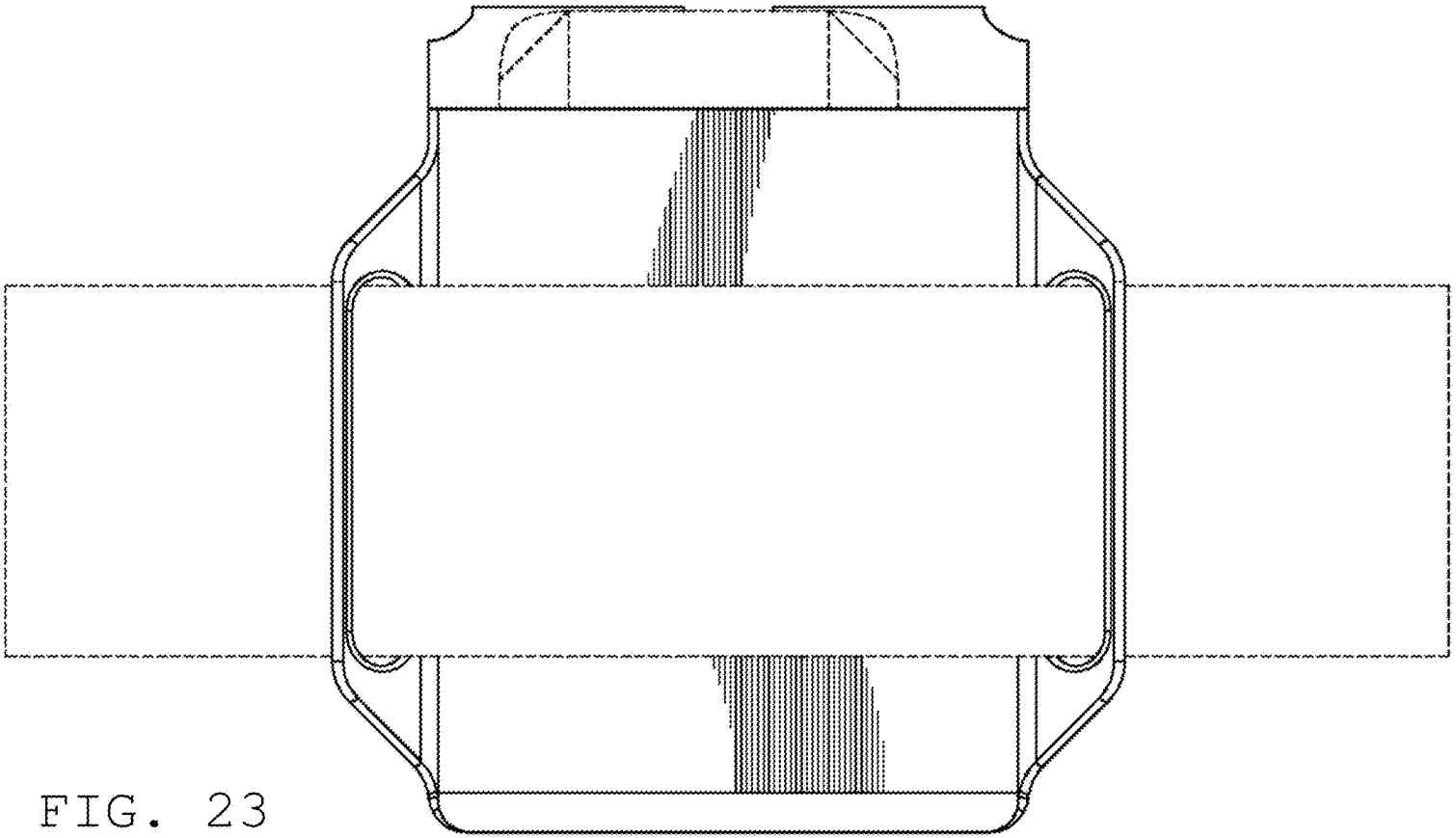
FIG. 23 is a rear view of the alternate embodiment of the belt pouch having double duty capability, including a belt to which the design is attached.
Figure 24:
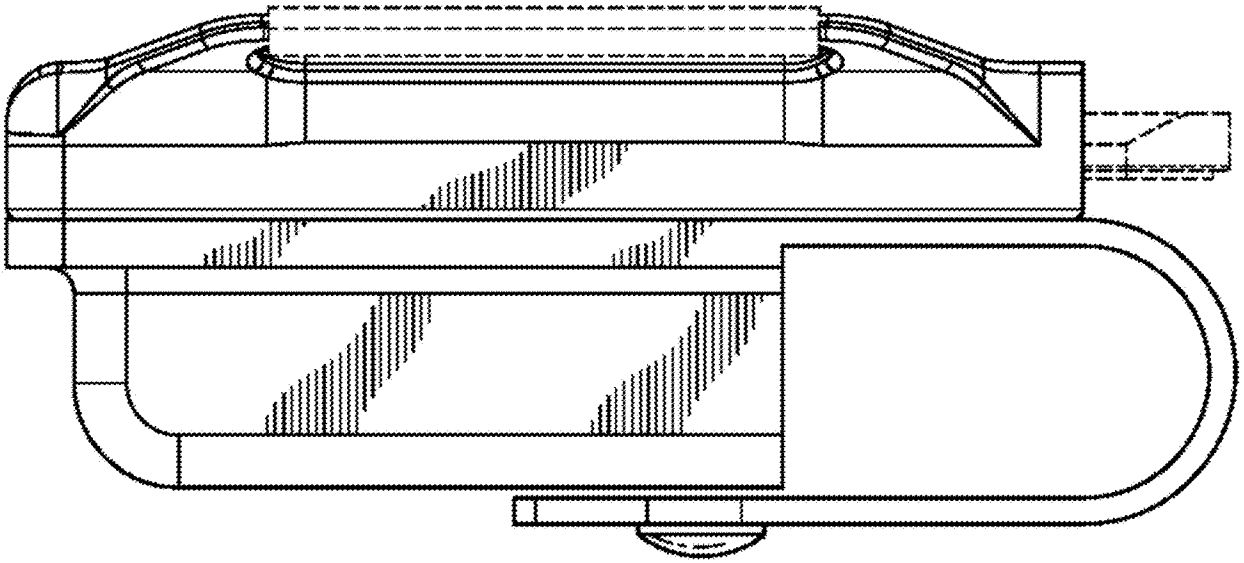
FIG. 24 is a right side plan view of the alternate embodiment of the belt pouch having double duty capability, including a belt to which the design is attached.
Figure 25:
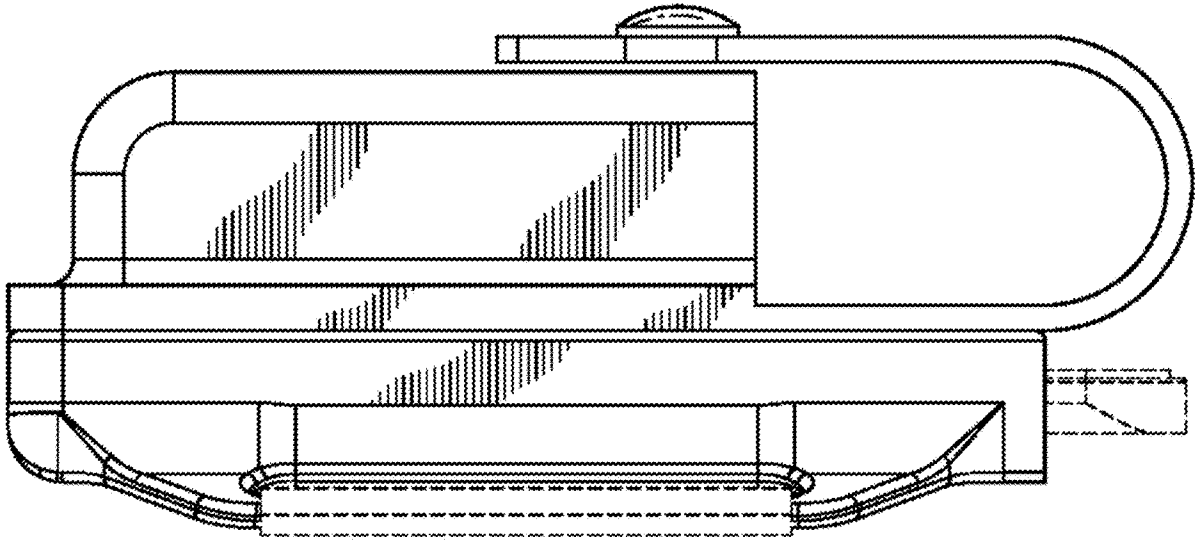
FIG. 25 is a left side plan view the alternate embodiment of the belt pouch having double duty capability.
Figure 26:
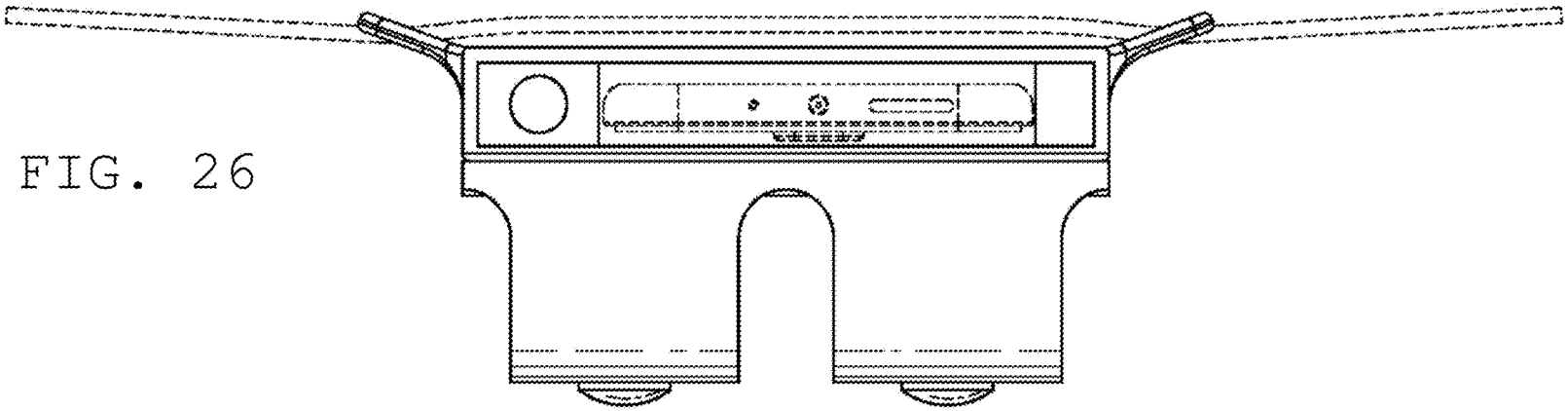
FIG. 26 is a top plan view of the alternate embodiment of the belt pouch having double duty capability without a protective flap.
Figure 27:
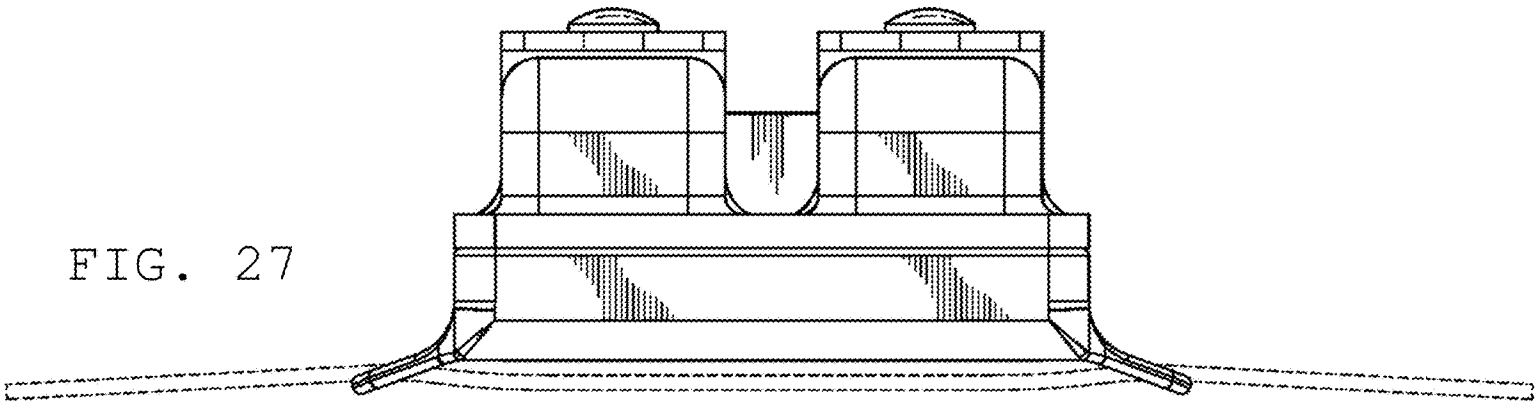
FIG. 27 is a bottom plan view of the alternate embodiment of the belt pouch having double duty capability without a protective flap.
Figure 28:
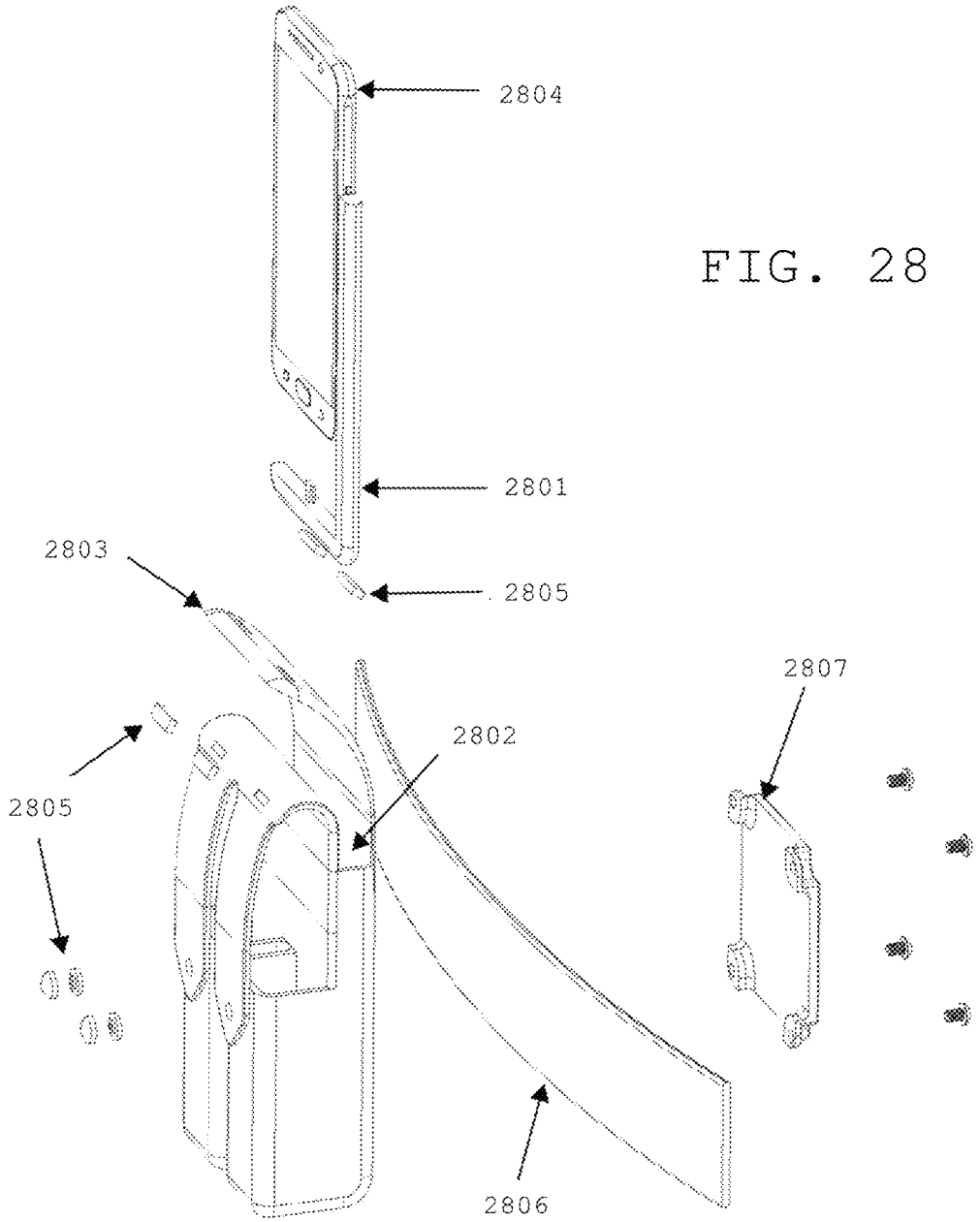
FIG. 28 is an exploded view of a pouch system in a vertical orientation with belt mount.

FIG. 14 illustrates a top perspective view showing the top, front, and right sides of a belt pouch having double duty capability. FIG. 15 is a rear view of the belt pouch having double duty capability, including a belt to which the design is attached. FIG. 16 is a top plan view of the belt pouch having double duty capability, including a belt to which the design is attached. FIG. 17 is a front view of the belt pouch having double duty capability, including a belt to which the design is attached. FIG. 18 is a right side plan view the belt pouch having double duty capability, and FIG. 19 is a left side plan view of the belt pouch having double duty capability including a protective flap. FIG. 20 is a top view of the belt pouch having double duty capability, with a smartphone and smartphone specific MIS provided. FIGS. 21 through 27 illustrate an alternate embodiment of the present design wherein no flap is provided to cover the computing device/smartphone and is otherwise similar to the representations of FIGS. 14 through 20.

FIGS. 28, 29A, 29B, 29C, 30A, 30B, and 30C show an exploded view of the design in a vertical configuration. The modular insert system (MIS) 2801 engages in the opening of the secondary pouch 2802 which may be covered by the protective flap 2803. A smartphone or other device 2804 is shown as engaging with the MIS. The design also shows various closure snaps, magnets or other systems 2805 that may be attached to the design in order to secure the flaps or other parts. The design also includes belt 2806 and a detachable belt mounting system 2807 which may be attached to the back of the pouch system.

FIGS. 31A, 31B, 32A, 32B, and 32C show the design with a detachable belt mounting system 3101 attached to a belt 3102. In these depictions, the pouch system is oriented in a horizontal manner so that the magazine pouch flaps 3103 as well as the secondary pouch flaps 3104 open sideways. In this depiction, the contents of the pouch may be removed or inserted into the pouch sideways, i.e. in an orientation parallel to the belt or horizontally when the user is standing.

Figure 33:
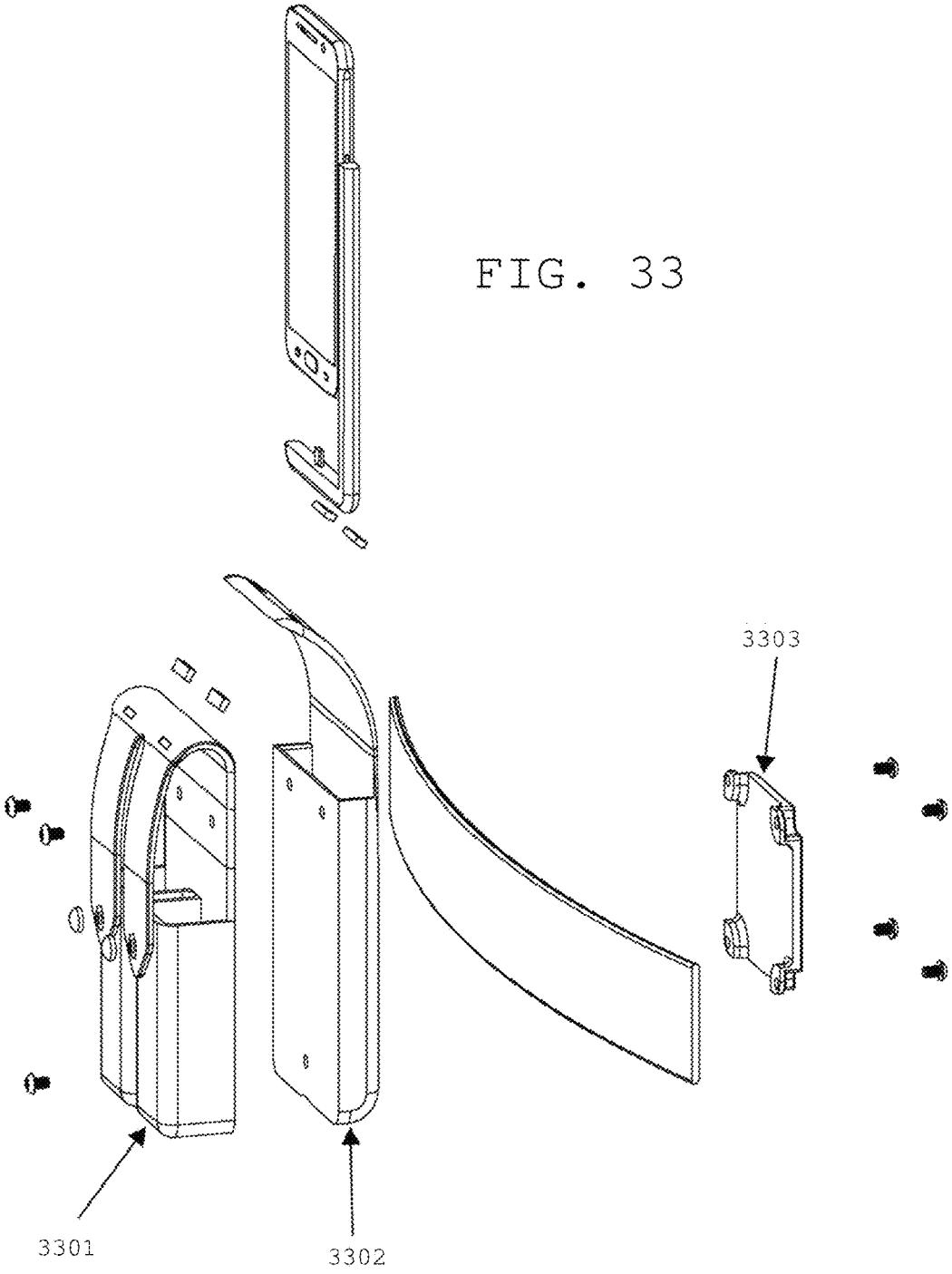
FIG. 33 shows an exploded view of a pouch system in a horizontal orientation with the secondary opening on top.

FIG. 33 shows an embodiment of the pouch system wherein the magazine pouch 3301, the secondary pouch 3302 and the detachable belt mount 3303 are separate components which may be attached to each other via a variety of methods such as screws, rivets, glue, adhesives, Velcro or any other means. This represents a modular approach, allowing various components to be changed or reconfigured.

Figure 34:
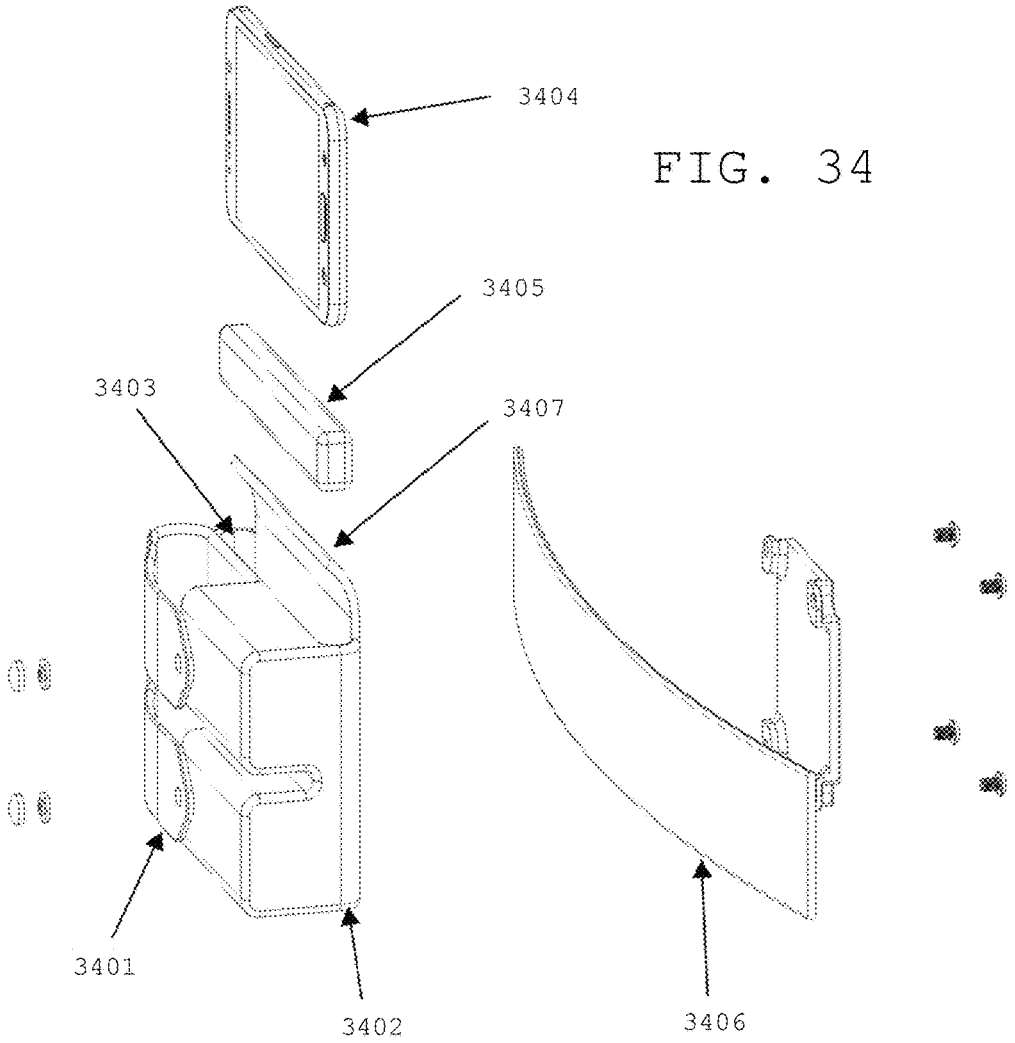
FIG. 34 is a pouch system in a horizontal orientation with the secondary opening flap open.
Figure 39A:
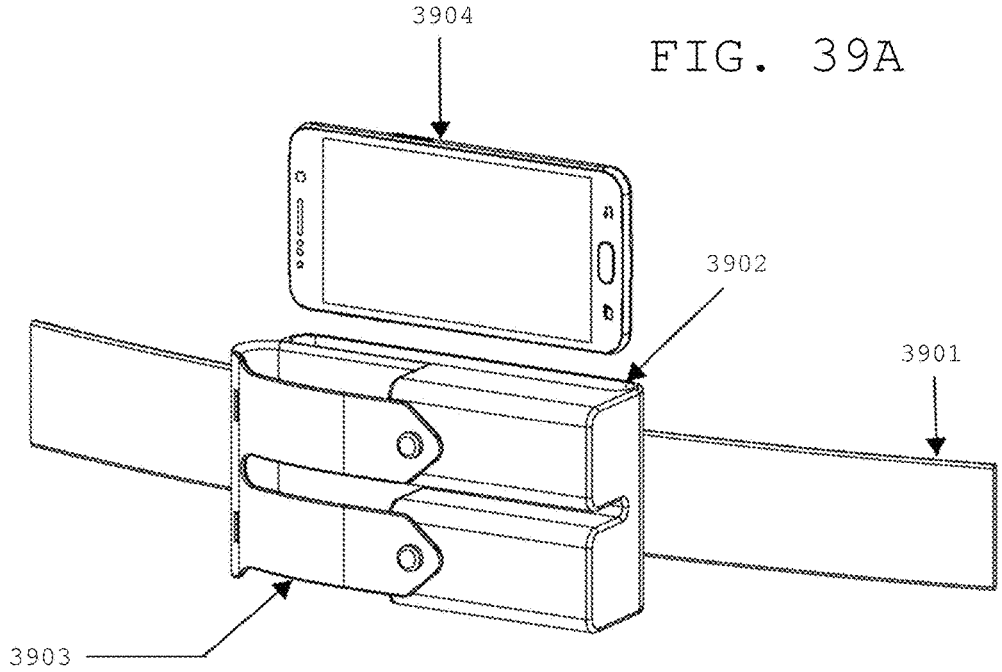
FIG. 39A represents a first view of a pouch system in a horizontal orientation without a secondary pouch opening.
Figure 39B:
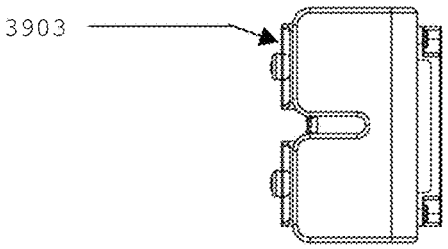
FIG. 39B is a second view of a pouch system in a horizontal orientation without a secondary pouch opening.
Figure 39C:
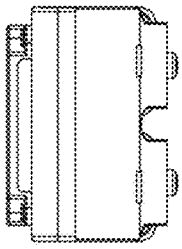
FIG. 39C shows a third view of a pouch system in a horizontal orientation without a secondary pouch opening.

FIG. 34 depicts the pouch system mounted in a horizontal orientation. The handgun magazines may be removed or inserted horizontally by opening the magazine pouch flaps 3401. The secondary pouch 3402 is shown with the opening 3403 on top. This allows a smartphone or other device 3404 to be inserted and removed vertically even though the pouch system is oriented horizontally. Also shown is a modular insert system component 3405. FIGS. 35A, 35B, 35C, 36A, 36B, and 36C illustrate the pouch system mounted on a belt 3406 in a horizontal configuration. A smartphone or other device 3404 is shown inserted into the opening 3403 of the secondary pouch 3402 with the flap 3407 in the open position. FIGS. 37A, 37B, 37C, 38A, 38B, and 38C show the pouch system with a smartphone or other device 3404 with the secondary flap 3407 closed.

FIGS. 39A, 39B, 39C, 40A, 40B, 40C, 41A, and 41B show a horizontally mounted pouch system on a belt 3901. The secondary pouch opening 3902 is on top while the magazine flap 3903 openings are on the side. The secondary pouch opening 3902 is illustrated without a flap or other enclosure on top and smartphone or other device 3904.

As shown herein, there is provided a design with a plurality of pouches and receptacles configured to provide multiple capabilities and sometimes referred to as a "double duty" system. Each receptacle provided is utilized for separate purposes thereby increasing the utility of the pouches while not negatively materially impacting the amount of space needed to carry equipment. In various aspects of the design, the pouch system may have an open top or an enclosed system, which would provide security and weatherproofing. According to one aspect of the design, a purpose built secondary pouch system is provided and attached to the primary pouch receptacle. The secondary pouch may be used to hold various items of equipment such a smartphone, recording device or other items.

In another aspect of the design, the double duty pouch employs a modular insert system (MIS) provided in the secondary pouch. The MIS is purpose built to hold various items of equipment. The MIS can be removed and exchanged for an MIS having different configurations accommodating different items. The MIS may contain a battery system and circuitry while maintaining the capacity to store a cellphone, smartphone or other electronic device. Such a battery system provides the ability to recharge electronic devices such as smartphones and cellphones while they are carried within the pouch system.

The MIS system may also contain circuitry, GPS devices or functionality, recording systems, and/or other devices, and may provide connections or connectivity from a device (smartphone or cellphone, for example) to the user's duty belt and/or other equipment maintained by or on the person of the wearer. The overall system may include the aforementioned MIS and circuitry and/or connections to the duty belt upon which the pouch system is attached while taking up minimal or no extra room on the duty belt. The entirety of the present design provides an integrated system of pouches, electronics, sensors, batteries and controls yielding additional functionality at little or no additional space cost on the officer's duty belt or person.

An apparatus with a plurality of pouches and receptacles configured to provide multiple capabilities and herein as referenced as a "double duty" system. Each receptacle provided is utilized for separate purposes thereby increasing the utility of the pouches while not negatively impacting the amount of space needed to carry equipment. In various aspects of the design, the pouch system may have an open top or an enclosed system, which would provide security and weatherproofing.

Thus according to one aspect of the design, a purpose built secondary pouch system is created and attached to the primary pouch receptacle. The secondary pouch may be used to hold various items of equipment such a smartphone, recording device or other items. The double duty pouch may incorporate a modular insert system MIS inserted into the secondary pouch. The MIS is purpose built and may hold various items of equipment. The MIS can be removed and exchanged for an MIS in various configurations to provide for custom fit irrespective of the item of equipment carried. The MIS may contain a battery system and circuitry while maintaining the capacity to store a cellphone, smartphone or other similar device. This battery system may provide the capability of recharging smartphones, cellphones or other devices while carried within the pouch system.

In one embodiment of the present design, there is provided an apparatus comprising an ammunition magazine, a container fixedly connected to the ammunition magazine, a modular insert configured to fixedly fit within the container, in one embodiment having an opening therein sized to receive an electrical device, and attachment hardware configured to attach the container to a belt worn by a user.

According to another aspect of the design, there is provided an apparatus configured to hold ammunition comprising a magazine, a container attached to a back side of the magazine, a modular insert configured to fixedly fit within the container and having an opening therein, and attachment hardware configured to attach the container to a belt worn by a user. In one embodiment, the modular insert is sized to receive an electrical device.

According to a third aspect of the design, there is provided a belt mountable apparatus configured to hold ammunition comprising a magazine, a container attached to a back side of the magazine, and a modular insert configured to fixedly fit within the container and in one embodiment having an opening therein sized to receive an electrical device.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but is to be accorded the widest scope consistent with the principles and novel features disclosed herein.

What is claimed is:

1. An apparatus comprising:

an ammunition magazine;

a container fixedly connected to a rear side of the ammunition magazine, wherein the container has an opening formed behind the ammunition magazine;

a modular insert configured to fixedly fit within the opening formed in the container and having a modular insert opening therein sized to receive an electrical device; and attachment hardware configured to attach the container to a belt worn by a user.

2. The apparatus of claim 1, wherein the modular insert is generally U-shaped, forming a U, and comprises an electrical connection at the bottom of the U.

3. The apparatus of claim 2, wherein the electrical device comprises a smartphone, and the electrical connection is a male smartphone connector positioned to mate with a female connection provided on the smartphone.

4. The apparatus of claim 2, wherein the electrical device comprises a smartphone, the modular insert is configured to maintain a power source, and the power source is electrically connected to the smartphone when the smartphone is positioned within the modular insert.

5. The apparatus of claim 1, wherein the modular insert is L-shaped and comprises an electrical connection at the bottom of the L shape.

6. The apparatus of claim 1, wherein the electrical device comprises a smartphone.

7. The apparatus of claim 1, wherein the attachment hardware comprises at least one attachment point formed on one side of the container.

8. The apparatus of claim 1, wherein the container further comprises a flap attached thereto configured to connect with the ammunition magazine.

9. The apparatus of claim 1, wherein the modular insert is configured to maintain a power source.

10. The apparatus of claim 9, wherein the modular insert further comprises a connection to the power source.

11. The apparatus of claim 1, wherein the modular insert comprises an external button, switch, display or other control device.

12. An apparatus configured to hold ammunition comprising:

a magazine configured to maintain ammunition;

a container attached to a back side of the magazine, wherein the container has an opening formed behind the magazine;

a modular insert configured to fixedly fit within the opening formed in the container and having a modular insert opening therein; and attachment hardware configured to attach the container to a belt worn by a user.

13. The apparatus of claim 12, wherein the modular insert is sized to receive an electrical device.

14. The apparatus of claim 13, wherein the modular insert is generally U-shaped, forming a U, and comprises an electrical connection at the bottom of the U.

15. The apparatus of claim 13, wherein the electrical device comprises a smartphone.

16. The apparatus of claim 13, wherein the electrical device comprises a smartphone, and the electrical connection is a male smartphone connector positioned to mate with a female connection provided on the smartphone.

17. The apparatus of claim 13, wherein the modular insert is configured to maintain a power source.

18. The apparatus of claim 13, wherein the electrical device comprises a smartphone, the modular insert comprises a power source, and the power source is electrically connected to the smartphone when the smartphone is positioned within the modular insert.

19. A belt mountable apparatus configured to hold ammunition comprising:

a magazine configured to maintain ammunition;

a container attached to a back side of the magazine, wherein the container has an opening formed behind the magazine; and a modular insert configured to fixedly fit within the opening formed in the container and having a modular insert opening therein sized to receive an electrical device.

20. The belt mountable apparatus of claim 19, wherein the modular insert is generally U-shaped, forming a U, and comprises an electrical connection at the bottom of the U.

21. The belt mountable apparatus of claim 19, wherein the electrical device comprises a smartphone.

22. The belt mountable apparatus of claim 19, wherein the electrical device comprises a smartphone, and the electrical connection is a male smartphone connector positioned to mate with a female connection provided on the smartphone.

23. The belt mountable apparatus of claim 19, wherein the modular insert is configured to maintain a power source.

24. The belt mountable apparatus of claim 19, wherein the electrical device comprises a smartphone, the modular insert comprises a power source, and the power source is electrically connected to the smartphone when the smartphone is positioned within the modular insert.

25. The belt mountable apparatus of claim 19, wherein the magazine is mounted horizontally when deployed on a belt.

26. The belt mountable apparatus of claim 19, wherein the magazine is mounted vertically when deployed on a belt.

* * * * *